US007874501B2

(12) United States Patent
Griese et al.

(10) Patent No.: US 7,874,501 B2
(45) **Date of Patent: *Jan. 25, 2011**

(54) PRODUCT DISPENSER AND CARRIER

(75) Inventors: Gregory G. Griese, Hudson, WI (US); John E. Thomas, River Falls, WI (US); Jamie W. Lerbs, Mendota Heights, MN (US); Steven E. Lentsch, St. Paul, MN (US); Stephan M. Hubig, Maplewood, MN (US); Terry J. Klos, Victoria, MN (US); Ronald B. Howes, Jr., Minneapolis, MN (US); Eric R. Balz, Stillwater, MN (US)

(73) Assignee: Ecolab USA Inc., St. Paul, MN (US)

( * ) Notice: Subject to any disclaimer, the term of this patent is extended or adjusted under 35 U.S.C. 154(b) by 86 days.

This patent is subject to a terminal disclaimer.

(21) Appl. No.: 11/957,578

(22) Filed: Dec. 17, 2007

(65) Prior Publication Data

US 2009/0001192 A1 Jan. 1, 2009

Related U.S. Application Data

(63) Continuation of application No. 10/781,332, filed on Feb. 18, 2004, now Pat. No. 7,309,026, which is a continuation-in-part of application No. 10/655,538, filed on Sep. 4, 2003, now Pat. No. 6,910,640, which is a continuation-in-part of application No. 10/411,062, filed on Apr. 9, 2003, now Pat. No. 6,779,740, which is a continuation-in-part of application No. 10/121,440, filed on Apr. 10, 2002, now Pat. No. 6,883,723.

(51) Int. Cl.
*A61L 9/04* (2006.01)

(52) U.S. Cl. ..... 239/43; 239/57; 239/60; 15/231

(58) Field of Classification Search ..... 239/43, 239/60, 83, 57; 510/519; 15/231
See application file for complete search history.

(56) References Cited

U.S. PATENT DOCUMENTS 2,851,791 A 9/1958 Olthius (Continued)

FOREIGN PATENT DOCUMENTS

DE 2 350 574 4/1974

(Continued)

OTHER PUBLICATIONS

Reuseable Dryer Sheets NPL.*

(Continued)

*Primary Examiner*—Len Tran
*Assistant Examiner*—Trevor E McGraw
(74) *Attorney, Agent, or Firm*—IPLM Group, P.A.

(57) ABSTRACT

A product dispenser (10, 110, 210, 310, 410, 510, 610, 710, 720, 730, 740, 750, 760, 780, 800, 810, 820, 830, 840, 850, and 860) for attachment to a surface such as an inner surface of a dryer releasably attaches a product (31, 131, 431, 531, 713, 733, 743, 753, 763, 787, 804, 815, 825, 834, 844, 854, 862) to the surface.

24 Claims, 28 Drawing Sheets

U.S. PATENT DOCUMENTS

| | | | | |
|---|---|---|---|---|
| 3,442,692 | A | 5/1969 | Gaiser | |
| 3,676,199 | A | 7/1972 | Hewitt et al. | |
| 3,686,025 | A | 8/1972 | Morton | |
| 3,701,202 | A | 10/1972 | Compa et al. | |
| 3,804,330 | A | 4/1974 | Miller et al. | |
| 3,844,478 | A * | 10/1974 | Davis | 239/57 |
| 3,870,145 | A | 3/1975 | Mizuno | |
| 3,948,387 | A * | 4/1976 | Haertle | 206/524.6 |
| 3,967,008 | A | 6/1976 | Mizuno et al. | |
| 4,004,685 | A | 1/1977 | Mizuno et al. | |
| 4,014,432 | A | 3/1977 | Clothier et al. | |
| 4,098,937 | A * | 7/1978 | Mizuno et al. | 428/68 |
| 4,105,813 | A | 8/1978 | Mizuno | |
| 4,254,139 | A * | 3/1981 | Hendrickson et al. | 428/60 |
| 4,567,675 | A * | 2/1986 | Rennie | 34/60 |
| 4,570,888 | A | 2/1986 | Evans | |
| 4,677,760 | A | 7/1987 | St. Louis | |
| 4,753,389 | A | 6/1988 | Davis | |
| 4,840,773 | A | 6/1989 | Wade | |
| 4,891,890 | A | 1/1990 | Church | |
| 5,020,240 | A | 6/1991 | Lee | |
| 5,069,231 | A | 12/1991 | Rutherford | |
| 5,440,976 | A | 8/1995 | Giuliano et al. | |
| 5,658,651 | A | 8/1997 | Smith et al. | |
| 5,787,606 | A | 8/1998 | Bokholdt | |
| 5,869,410 | A | 2/1999 | Smith et al. | |
| 5,943,816 | A | 8/1999 | Hyatt et al. | |
| 5,966,831 | A * | 10/1999 | Anderson | 34/60 |
| 6,006,472 | A | 12/1999 | Holtkamp, Jr. | |
| 6,110,886 | A | 8/2000 | Scepanski | |
| 6,238,736 | B1 | 5/2001 | Smith et al. | |
| 6,254,932 | B1 | 7/2001 | Smith et al. | |
| 6,305,046 | B1 * | 10/2001 | Kingry et al. | 15/231 |
| 6,581,800 | B2 | 6/2003 | Rodd et al. | |
| 6,607,094 | B2 | 8/2003 | MacDonald | |
| 6,779,740 | B1 * | 8/2004 | Lentsch et al. | 239/43 |
| 6,883,723 | B2 * | 4/2005 | Griese et al. | 239/43 |
| 6,887,841 | B2 * | 5/2005 | Mattia et al. | 510/520 |
| 6,899,281 | B1 * | 5/2005 | Griese et al. | 239/60 |
| 6,908,041 | B2 * | 6/2005 | Griese et al. | 239/43 |
| 6,910,640 | B2 * | 6/2005 | Griese et al. | 239/43 |
| 6,910,641 | B2 | 6/2005 | Griese et al. | |
| 7,055,761 | B2 * | 6/2006 | Griese et al. | 239/60 |
| 7,093,771 | B2 * | 8/2006 | Griese et al. | 239/43 |
| 7,093,772 | B2 * | 8/2006 | Griese et al. | 239/43 |
| 7,309,026 | B2 * | 12/2007 | Griese et al. | 239/43 |
| 7,311,267 | B2 | 12/2007 | Griese et al. | |
| 2004/0222313 | A1 * | 11/2004 | Lentsch et al. | 239/43 |

FOREIGN PATENT DOCUMENTS

| | | |
|---|---|---|
| GB | 1 383 749 | 2/1975 |

OTHER PUBLICATIONS

Office Action issued during the prosecution of U.S. Appl. No. 10/121,440, filed Apr. 10, 2002, now U.S. Patent No. 6,883,723, granted Apr. 26, 2005, 9 pages (Jan. 22, 2004).

Office Action issued during the prosecution of U.S. Appl. No. 10/654,709, filed Sep. 4, 2003, now U.S. Patent No. 6,899,281, granted May 31, 2005, 12 pages (Jul. 7, 2004).

Office Action issued during the prosecution of U.S. Appl. No. 10/777,408, filed Feb. 12, 2004, now U.S. Patent No. 7,093,771, granted Aug. 22, 2006, 13 pages (Dec. 30, 2005).

Office Action issued during the prosecution of U.S. Appl. No. 10/848,333, filed May 17, 2004, now U.S. Patent No. 6,908,041, granted Jun. 21, 2005, 12 pages (Dec. 22, 2004).

Office Action issued during the prosecution of U.S. Appl. No. 10/952,131, filed Sep. 28, 2004, now U.S. Patent No. 7,055,761, granted Jun. 6, 2006, 14 pages (Oct. 3, 2005).

Office Action issued during the prosecution of U.S. Appl. No. 10/777,409, filed Feb. 12, 2004, now U.S. Patent No. 7,093,772, granted Aug. 22, 2006, 12 pages (Dec. 30, 2005).

Office Action issued during the prosecution of U.S. Appl. No. 10/777,452, filed Feb. 12, 2004, now U.S. Patent No. 6,910,641, granted Jun. 28, 2005, 14 pages (Nov. 29, 2004).

Office Action issued during the prosecution of U.S. Appl. No. 11/074,161, filed Mar. 7, 2005, now U.S. Patent No. 7,311,267, granted Dec. 25, 2007, 13 pages (Mar. 14, 2007).

Office Action issued during the prosecution of U.S. Appl. No. 10/411,062, filed Apr. 9, 2003, now U.S. Patent No. 6,779,740, granted Aug. 24, 2004, 13 pages (May 3, 2004).

Office Action issued during the prosecution of U.S. Appl. No. 10/655,538, filed Sep. 4, 2003, now U.S. Patent No. 6,910,640, granted Jun. 28, 2005, 39 pages (Nov. 29, 2004).

Office Action issued during the prosecution of U.S. Appl. No. 10/781,332, filed Feb. 18, 2004, now U.S. Patent No. 7,309,026, granted Dec. 18, 2007, 19 pages (Apr. 12, 2007).

Ecolab Inc., Photos A-C showing Easy Soft™ 12 Fabric Softener 14082, a product similar to a product first publicly disclosed Jun. 1, 2002 and first offered for sale Jun. 5, 2002 differing only in color of the product dispenser and carrier, a product also similar to that shown in Figures 13 and 14 and described on p. 14, line 5 through p. 16, line 9 of U.S. Appl. No. 10/121,440 and shown in Figures 13, 14 and 23 and described on p. 16, line 4 through p. 19, line 17 of U.S. Appl. No. 10/411,062, now U.S. Patent No. 6,779,740.

* cited by examiner

FIG. 8
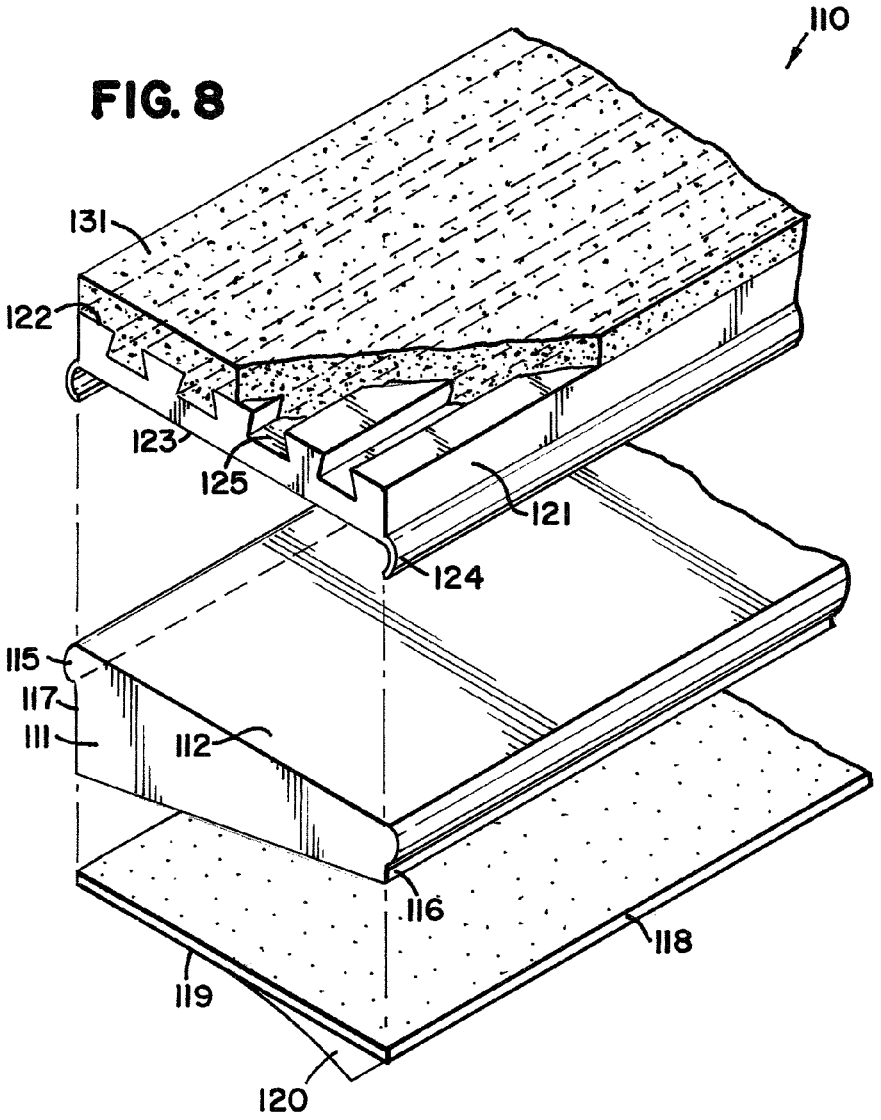
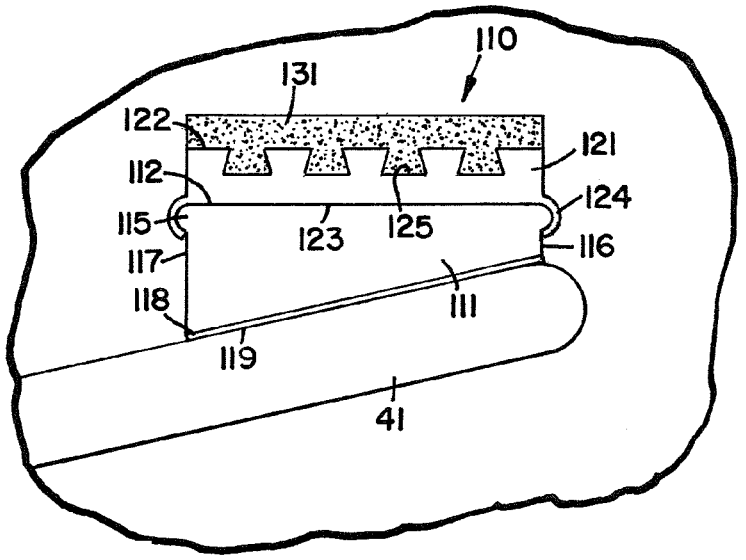
FIG. 9

FIG. 23
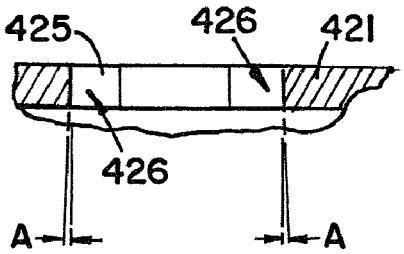
FIG. 24A
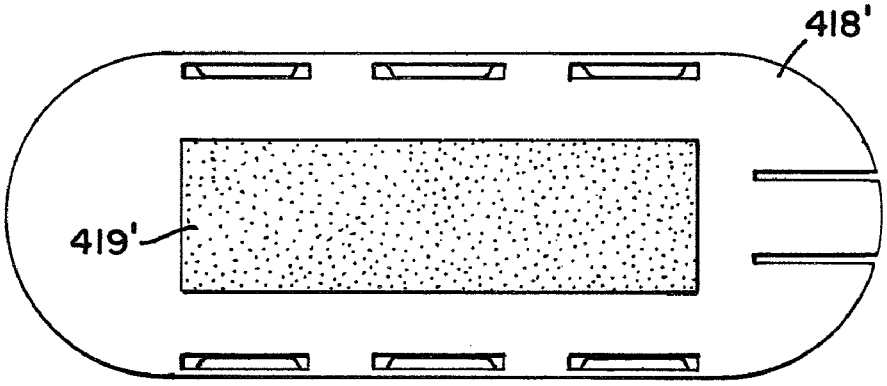
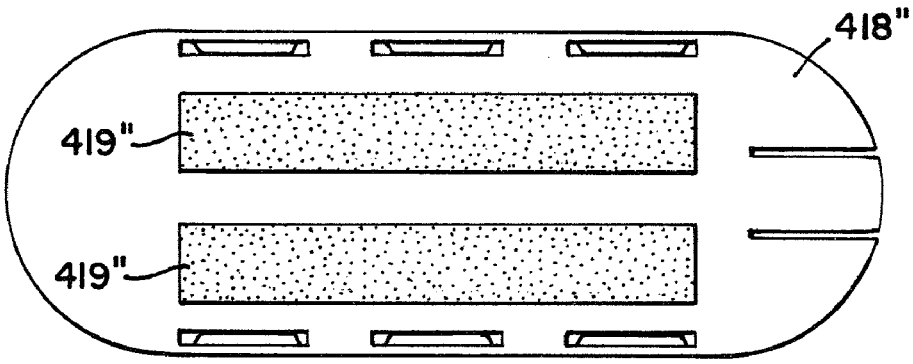
FIG. 24B

FIG. 46
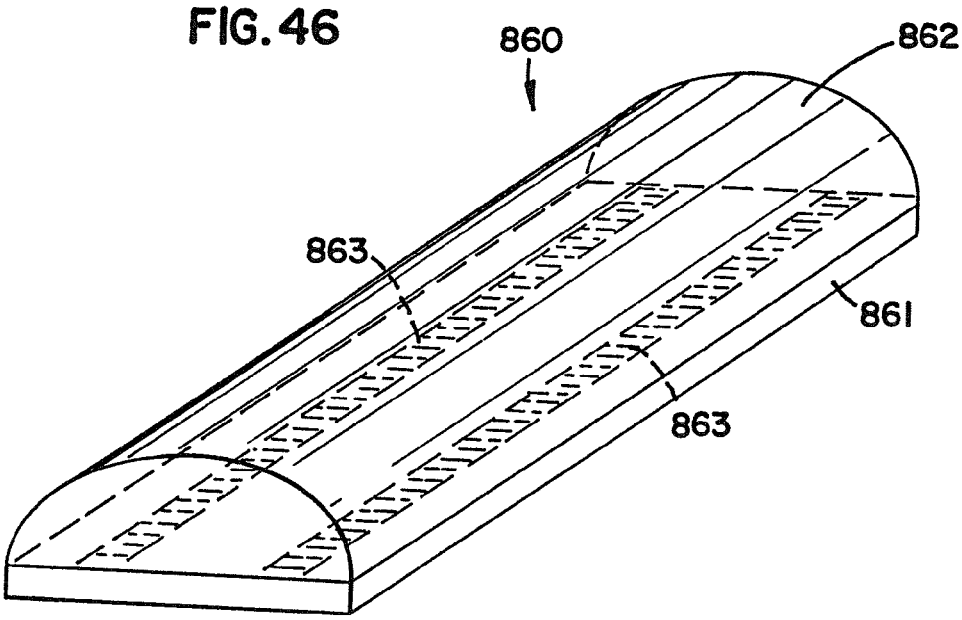
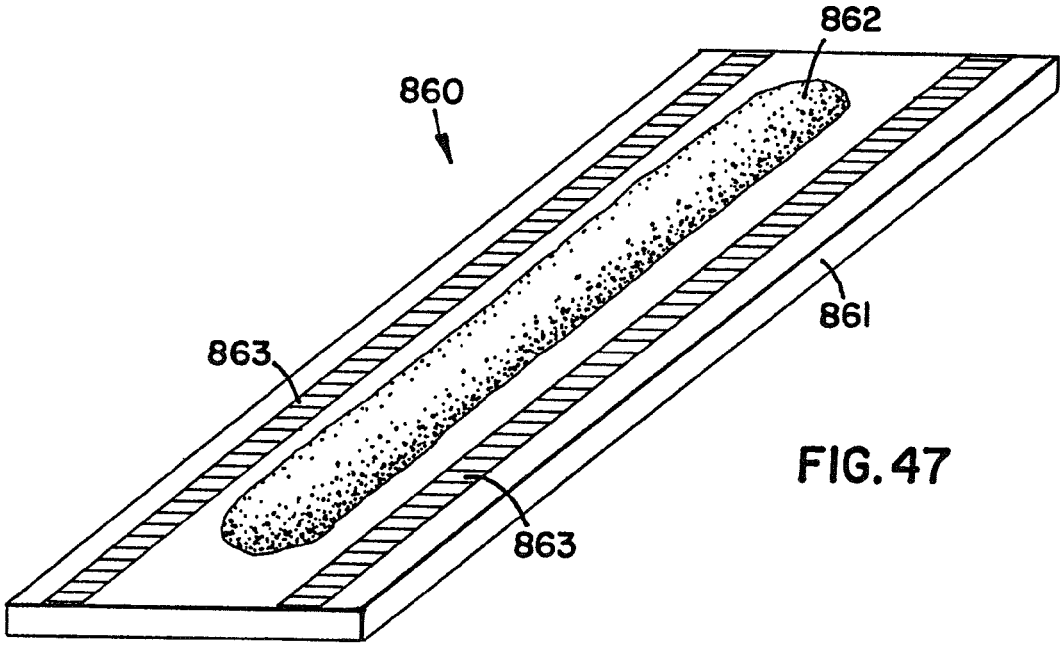
FIG. 47

PRODUCT DISPENSER AND CARRIER

This application is a continuation of U.S. patent application Ser. No. 10/781,332, filed Feb. 18, 2004, which is a continuation-in-part of U.S. patent application Ser. No. 10/655,538, filed Sep. 4, 2003, now U.S. Pat. No. 6,910,640, which is a continuation-in-part of U.S. patent application Ser. No. 10/411,062, filed Apr. 9, 2003, now U.S. Pat. No. 6,779,740, which is a continuation-in-part of U.S. patent application Ser. No. 10/121,440, filed Apr. 10, 2002, now U.S. Pat. No. 6,883,723, which are incorporated by reference herein.

BACKGROUND OF THE INVENTION

1. Field of the Invention

The present invention relates to a product dispenser and carrier, and more particularly, the present invention relates to a product dispenser and carrier for dispensing a solid fabric conditioner inside a dryer.

2. Description of the Prior Art

Laundry additives are commonly applied to laundry via a liquid either prior to or during the wash cycle or via a treated sheet during the dryer cycle. Laundry may be pre-treated prior to the wash cycle, or the liquid additive mixes with the water during the wash cycle to contact the laundry. The treated sheet tumbles around in the dryer during the dryer cycle to contact the laundry. For best results, either another dose of the liquid or a new treated sheet must be applied each time. Although treated sheets may be used more than one time, they become much less effective with each subsequent cycle. Therefore, using a new treated sheet each time works best to have consistent, effective results on the laundry. In addition, other types of laundry products can be applied prior to placing the laundry in either the washer and/or the dryer. For example, pre-treatment products in either a liquid or a semi-solid form may be applied to the laundry. However, again these products must be applied to the laundry each time before the appropriate cycle.

SUMMARY OF THE INVENTION

One aspect of the present invention provides a dispenser for dispensing a fabric conditioner in a dryer, the dispenser being releasably attachable to an inner surface of the dryer, including a product carrier and a solid fabric conditioner product. The product carrier has a first side, a second side, and a plurality of voids. The solid fabric conditioner product is operatively connected to the product carrier. A minor portion of the solid fabric conditioner product fills the plurality of voids and a substantial portion of the solid fabric conditioner product extends from the first side of the product carrier and is exposed. The minor portion fills the plurality of voids, which allows the solid fabric conditioner product to be securely connected to the product carrier.

Another aspect of the present invention provides a dispenser for dispensing a fabric conditioner in a dryer, the dispenser being releasably attachable to an inner surface of the dryer, including a product carrier and a solid fabric conditioner product. The product carrier has a first side, a second side, and a void forming an opening proximate the first side and a cavity proximate between the first side and the second side. The opening provides access to the cavity. The solid fabric conditioner product is operatively connected to the product carrier. A minor portion of the solid fabric conditioner product fills the void and a substantial portion of the solid fabric conditioner product extends from the first side of the product carrier and is exposed. The minor portion fills the void, which secures the solid fabric conditioner to the product carrier.

Another aspect of the present invention provides a method of making a dispenser for dispensing a fabric conditioner in a dryer, the dispenser being releasably attachable to an inner surface of the dryer. A product carrier is obtained. The product carrier has a first side, a second side, and a void forming an opening proximate the first side and a cavity proximate between the first side and the second side. The opening provides access to the cavity. A method selected from the group consisting of casting, extrusion, and injection molding is used to dispense a fabric conditioner product onto the product carrier. A minor portion of the fabric conditioner product fills the cavity and a substantial portion of the fabric conditioner product extends from the first side of the product carrier and is exposed. The fabric conditioner product is allowed to solidify onto the product carrier, wherein the minor portion solidifies within the cavity thus securing the solid fabric conditioner product onto the product carrier.

Another aspect of the present invention provides a dispensing system for dispensing a solid fabric conditioner, including a dryer, a product carrier, and a solid fabric conditioner. The dryer has an inner surface including a receiving member. The product carrier is configured and arranged to releasably engage the receiving member thereby releasably connecting the product carrier to the inner surface of the dryer. The product carrier includes a void. A minor portion of the solid fabric conditioner fills the void to secure the solid fabric conditioner to the product carrier. A substantial portion of the solid fabric conditioner extends from the product carrier and is exposed.

BRIEF DESCRIPTION OF THE DRAWINGS

FIG. 8 is an exploded top perspective view of another embodiment product dispenser and carrier constructed according to the principles of the present invention;

FIG. 9 is an end view of the product dispenser and carrier shown in FIG. 8 attached to a dryer fin;

FIG. 23 is a cross sectional view of an aperture taken along the lines 23-23 in FIG. 13;

FIG. 24*a* is a back view of a plate member of the product dispenser and carrier shown in FIG. 13;

FIG. 24*b* is a back view of another embodiment plate member of the product dispenser and carrier shown in FIG. 13;

FIG. 46 is a perspective view of another embodiment product dispenser and carrier constructed according to the principles of the present invention including an out of product indicator; and FIG. 47 is a perspective view of the product dispenser and carrier shown in FIG. 46 with depleted product exposing the out of product indicator.

DETAILED DESCRIPTION OF THE PREFERRED EMBODIMENT

Figure 1:
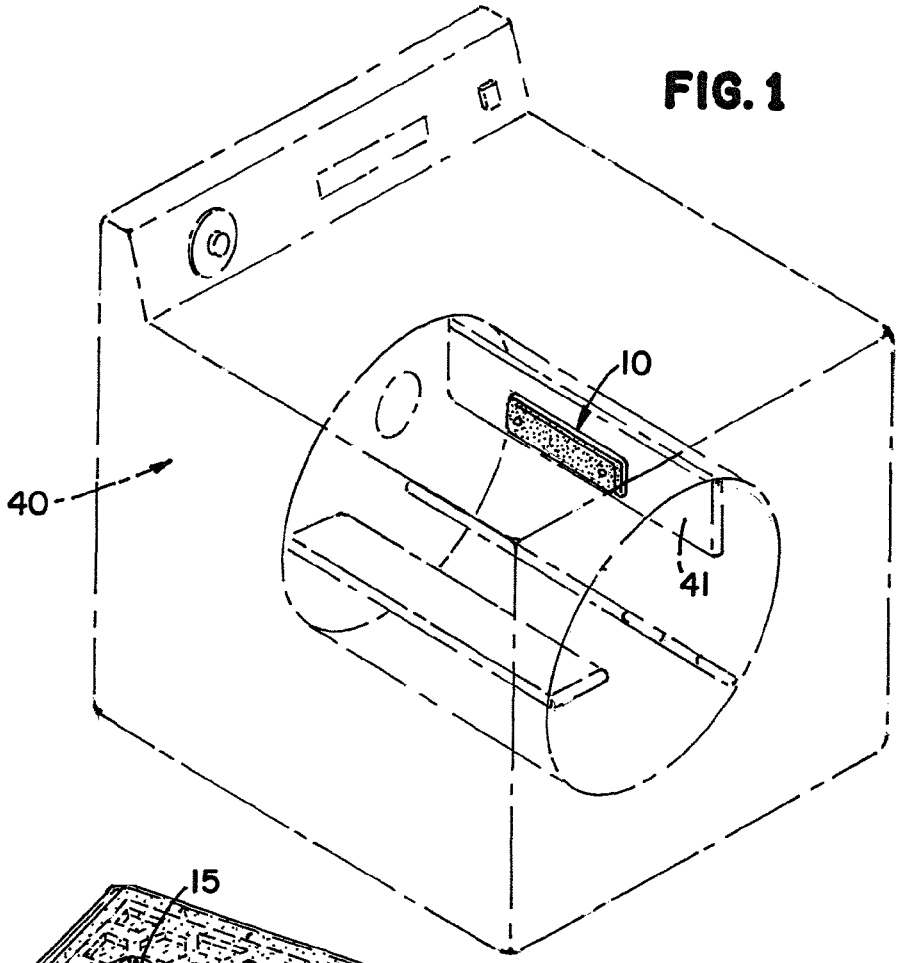
FIG. 1 shows a product dispenser and carrier constructed according to the principles of the present invention attached to a dryer fin.

Product dispensers and carriers constructed according to the principles of the present invention are designated by the numerals 10, 110, 210, 310, 410, 510, 610, 710, 720, 730, 740, 750, 760, 780, 800, 810, 820, 830, 840, 850, and 860 in the drawings.

Figure 2:
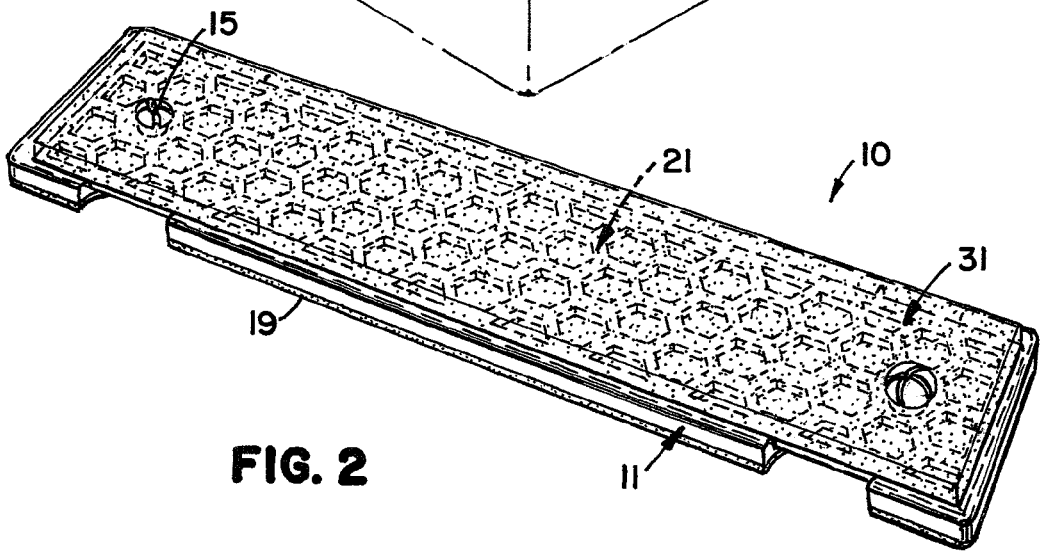
FIG. 2 is a top perspective view of the product dispenser and carrier shown in FIG. 1.
Figure 3:
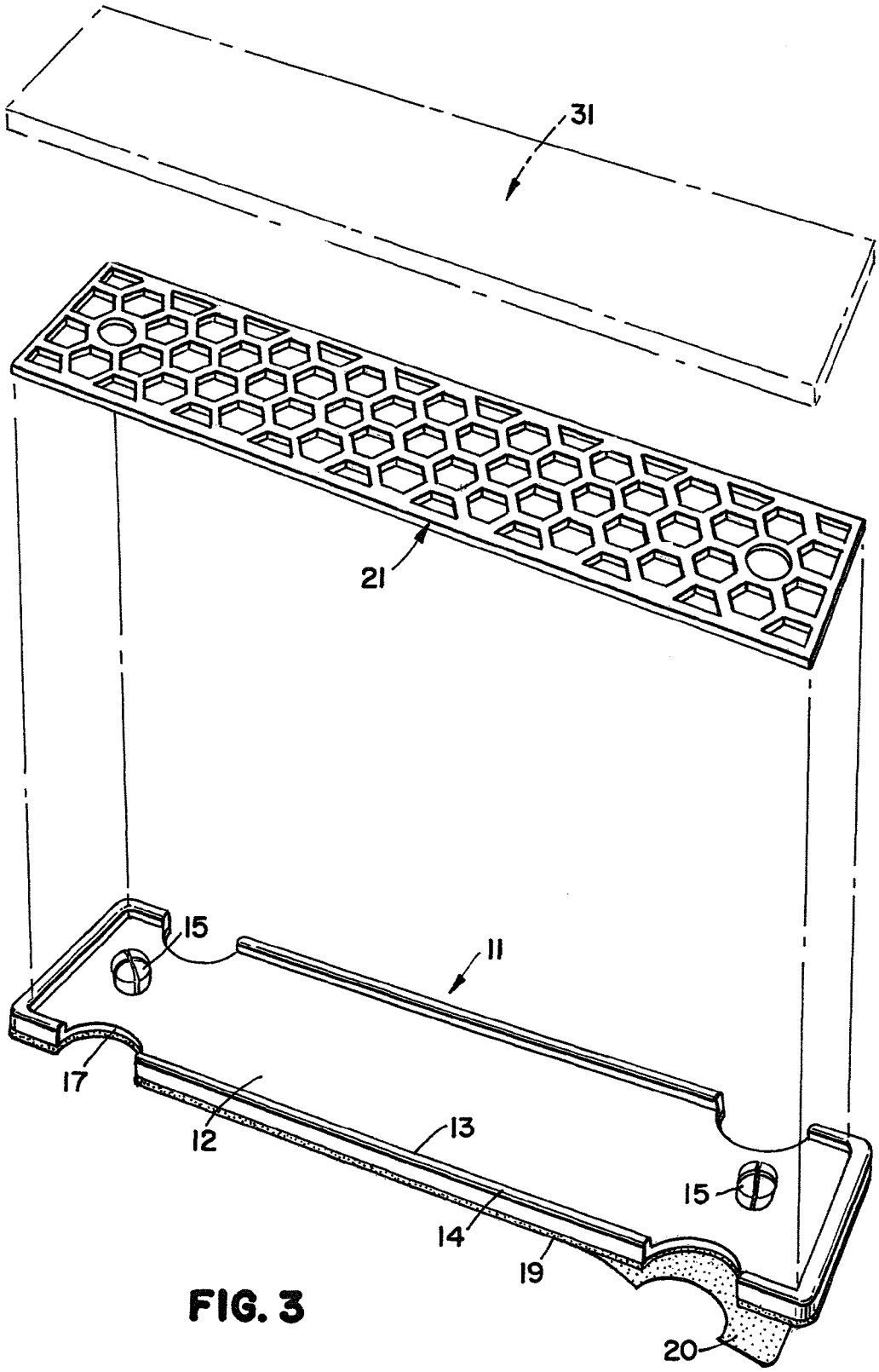
FIG. 3 is an exploded top perspective view of the product dispenser and carrier shown in FIG. 1.

In one preferred embodiment, the product dispenser and carrier 10 includes a plate member 11 and a product carrier 21, which carries a product 31. An assembled product dispenser and carrier 10 is shown in FIG. 2, and an exploded view of the product dispenser and carrier 10 is shown in FIG.

3. Generally, the product carrier 21 is operatively connected to the plate member 11, which may be attached to a surface such as a fin 41 of a dryer 40, as shown in FIG. 1, to dispense the product 31 such as a solid fabric conditioner. Although the invention is described for use with fabric softeners, other products such as sanitizers, water repellants, deodorizers, bleaches, soil repellants, due-transfer inhibitors, fiber protecting polymers, fiber smoothers, UV light absorbers, anti-wrinkle agents, and etc. could also be used. Therefore, the present invention is not limited to use with fabric softeners.

The plate member 11 is rectangular in shape having dimensions of approximately 9⅜ inches long by 2⅜ inches wide by ¼ inch thick and is made of a high melt point plastic. It is recognized that many suitable types of plastics known in the art may be used as long as the melt point of the particular plastic is higher than the temperature of the dryer, which may depend upon whether an industrial dryer or a consumer dryer is used. More specifically, industrial dryers typically require higher melt point plastics than consumer dryers because typically higher temperatures are used in industrial dryers. If the melting point of the plastic is slightly higher than the temperature used in the dryer, the plastic may become distorted or deformed. Industrial dryers typically reach temperatures of up to approximately 240° F., consumer electric dryers typically reach temperatures of up to approximately 140° F., and consumer gas dryers typically reach temperatures of up to approximately 170-180° F. Plastics suitable for use in either industrial dryers or consumer dryers include nylon (a melting point of approximately 428° F.), polypropylene (a melting point of approximately 320° F.), acetal copolymer (a melting point of approximately 392° F.), and polyethylene terephthalate (a melting point of approximately 482° F.). Plastics suitable for consumer dryers include acrylic (a melting point of approximately 266° F.) and high density polyethylene (a melting point of approximately 266° F.). It is recognized that these plastics are illustrative and are not exhaustive as other suitable high melt point plastics known in the art may also be used.

Figure 10:
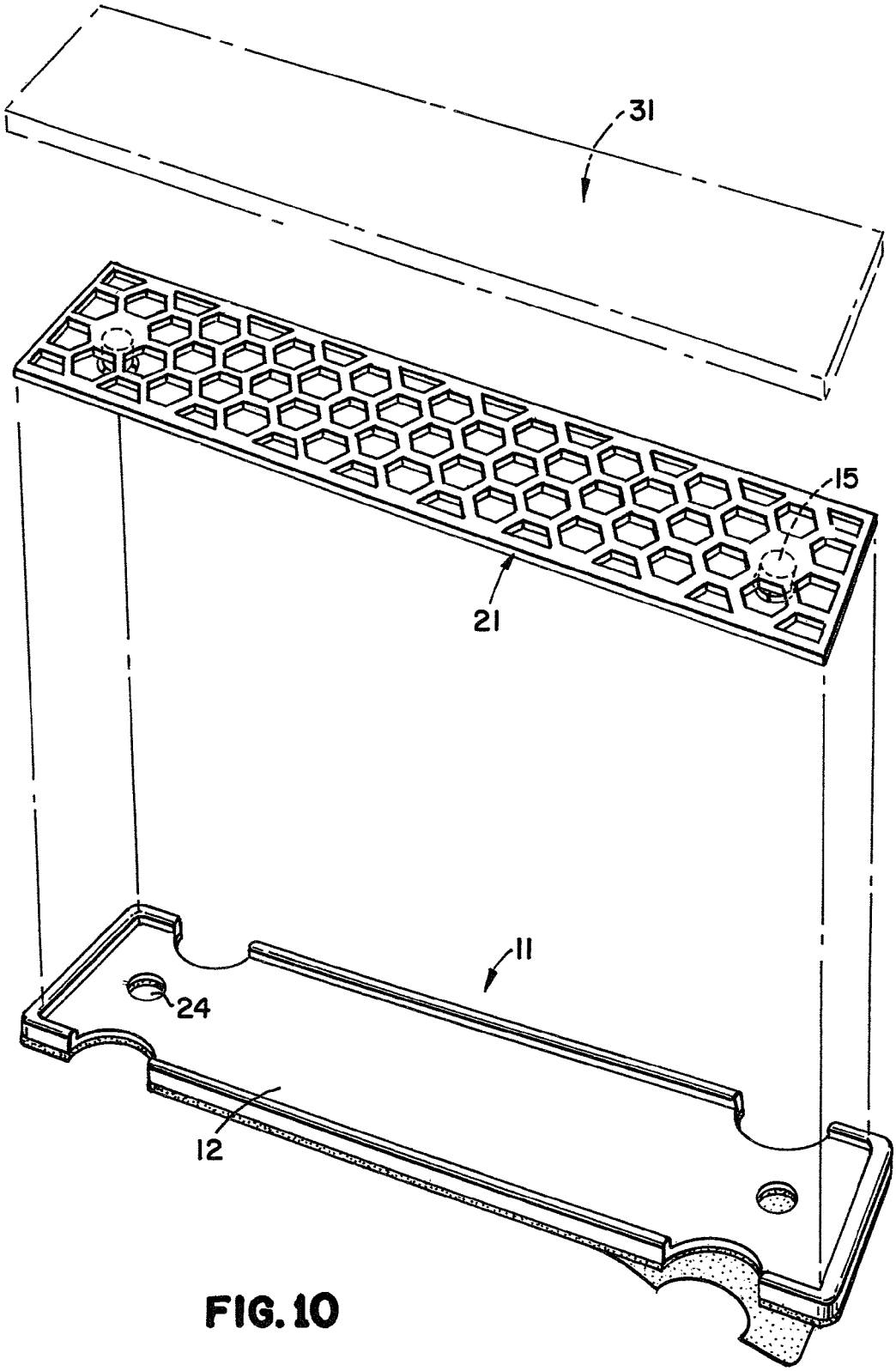
FIG. 10 is an exploded top perspective view of another embodiment product dispenser and carrier constructed according to the principles of the present invention.
Figure 11A:
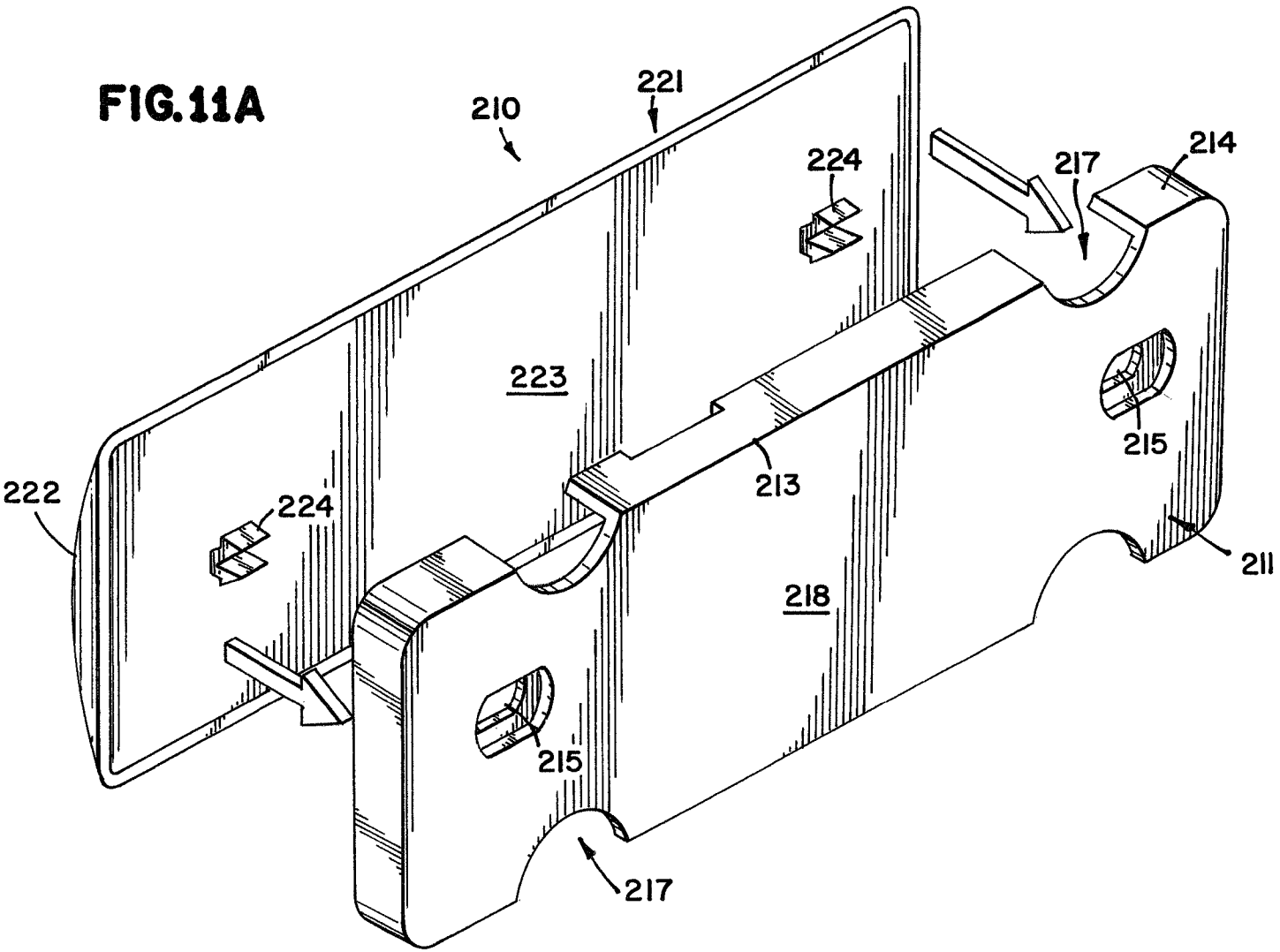
FIG. 11*a* is an exploded bottom perspective view of another embodiment product dispenser and carrier constructed according to the principles of the present invention.
Figure 11B:
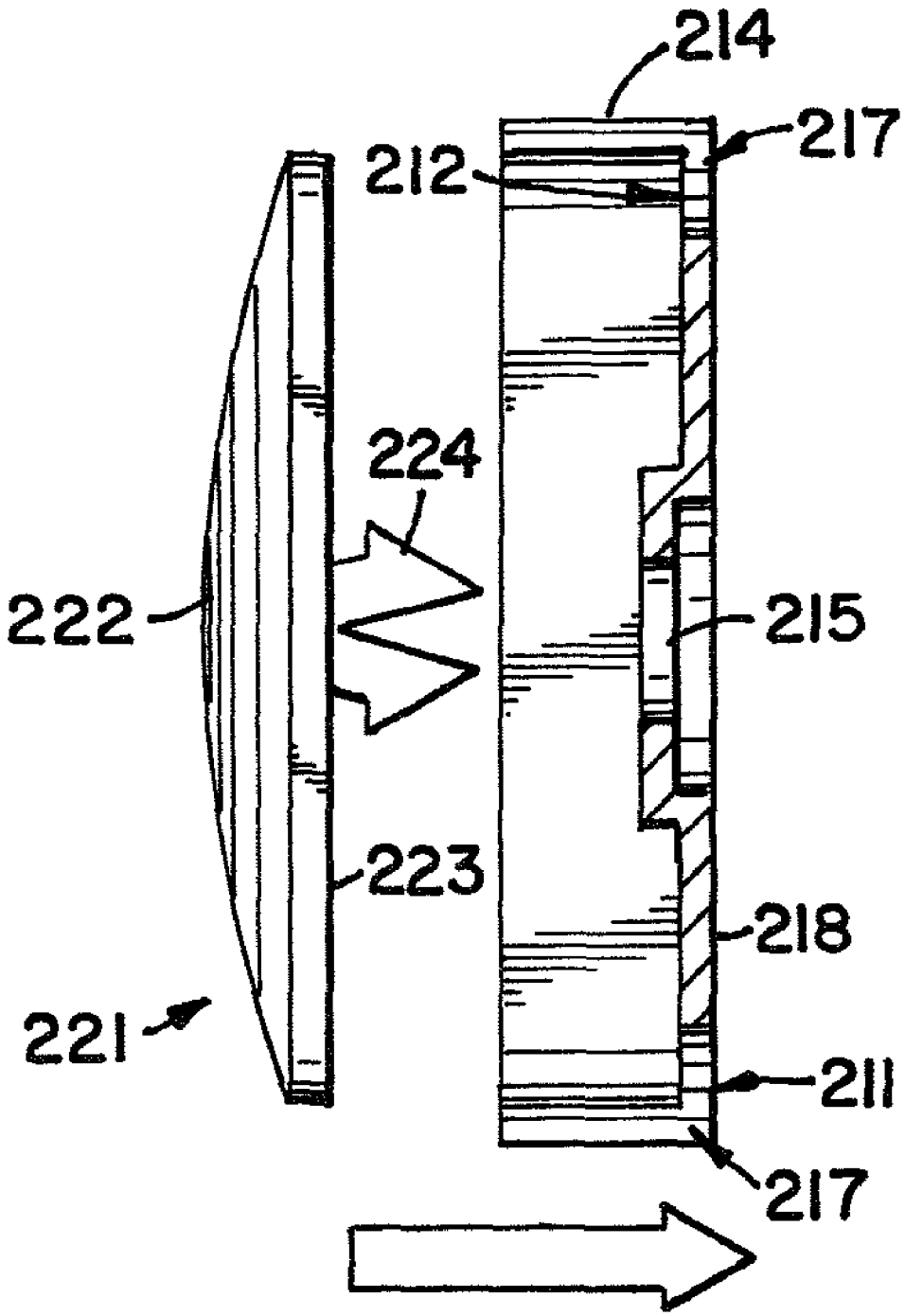
FIG. 11*b* is an exploded side view of the product dispenser and carrier shown in FIG. 11*a;*

The plate member 11 includes a front side 12 and a back side 18. The front side 12 has a perimeter 13, which is surrounded by a rail member 14. The rail member 14 protrudes slightly outward from the front side 12 and has rounded edges thereby creating a recessed area to accept and border the product carrier 21 within the rail member 14. The front side 12 also includes an attachment member 15, which in the preferred embodiment is a pair of hole plugs to provide releasable attachment means for operatively connecting the product carrier 21 to the plate member 11. One hole plug is located on each end of the plate member 11 and is configured and arranged to accommodate holes in the product carrier 21. The hole plugs are cylindrical and mushroom shaped with two slits at right angles to each other thereby dividing the hole plugs into four equal segments. The four segments allow the hole plugs to releasably engage the holes. As the hole plugs are pushed into the holes, the segments are brought closer together allowing the holes to snap down over the mushroom portion, which then protrudes from the holes and the segments are allowed to spread apart again thereby holding the product carrier 21 onto the plate member 11. The hole plugs could also be square in shape with an arrow head and a slit dividing the hole plug in two segments parallel to the arrow head, as shown in FIGS. 11*a* and 11*b*. To release the product carrier 21 from the hole plugs, the holes are brought over the mushroom portion of the hole plugs thereby bringing the segments together to allow the holes to pull over the mushroom portion and be released. The hole plugs may be molded as part of the plate member 11. However, the hole plugs 15 may also be molded as part of the product carrier 21 and engage holes 24 in the plate member 11 as shown in FIG. 10. Alternatively, the hole plugs could be a purchased part such as those commercially available from ITW Fastex, part number 207-241141-00 rather than molding them as part of the plate member 11 or product carrier 21. Although hole plugs and holes are shown in the preferred embodiment, it is understood that other attachment means such as snaps, VELCRO®, and other means known in the art may be used to connect the product carrier 21 to the plate member 11. The plate member 11 also includes indentations 17, which allow easy removal of the product carrier 21 when the product 31 has been depleted and the product carrier 21 must be replaced with a new product carrier, on each side near each end of the plate member 11. The indentations are sized and arranged to make removal of the product carrier 21 easy with one's fingers. Also, the product carrier 21 may simply be removed if dispensing of the particular product is not desired.

The back side 18 of the plate member 11 includes an adhesive 19, which is used to operatively connect the plate member 11 to a surface. The adhesive 19 in the preferred embodiment is a double-sided foam back tape manufactured by 3M, part number 4084, having a paper backing 20. The paper backing 20 may be removed when it is desired to attach the plate member 11 to a surface. Another type of adhesive that could be used is an adhesive similar to COMMAND™ Adhesive by 3M of St. Paul, Minn. This type of adhesive would allow for easy removal of the plate member 11 from the surface by pulling a tab to release the adhesive, and neither the plate member 11 nor the surface would be damaged when the adhesive is released. The releasable adhesive would have to withstand the temperatures used in the dryer or the adhesive may soften and lose adhesion or deteriorate. Replacement adhesive could be used to reattach the plate member 11 to a surface. Again, it is understood that other connecting means may be used to operatively connect the plate member 11 to a surface such as using VELCRO®, screws, magnets, and other means well known in the art.

For use inside a dryer, it is preferred that the adhesive or other suitable connecting member connect the plate member to the inner surface of the dryer such that laundry cannot get in between the plate member and the inner surface to pull the plate member away from the inner surface. This may be accomplished by positioning the adhesive or other suitable connecting member proximate the edges of the plate member to reduce or eliminate the gaps between the plate member and the inner surface from the adhesive or other suitable connecting member.

The product carrier 21 is also rectangular in shape and is configured and arranged to fit within the rail 14 of the plate member 11. The product carrier 21 is approximately 9 inches long by 2 inches wide by ⅛ inch thick and is made of a high melt point plastic. Again, as discussed previously with regard to the plate member 11, it is recognized that many suitable types of plastics known in the art may be used as long as the melt point of the particular plastic is higher than the temperature of the dryer, which may depend upon whether an industrial dryer or a consumer dryer is used.

Figure 4:
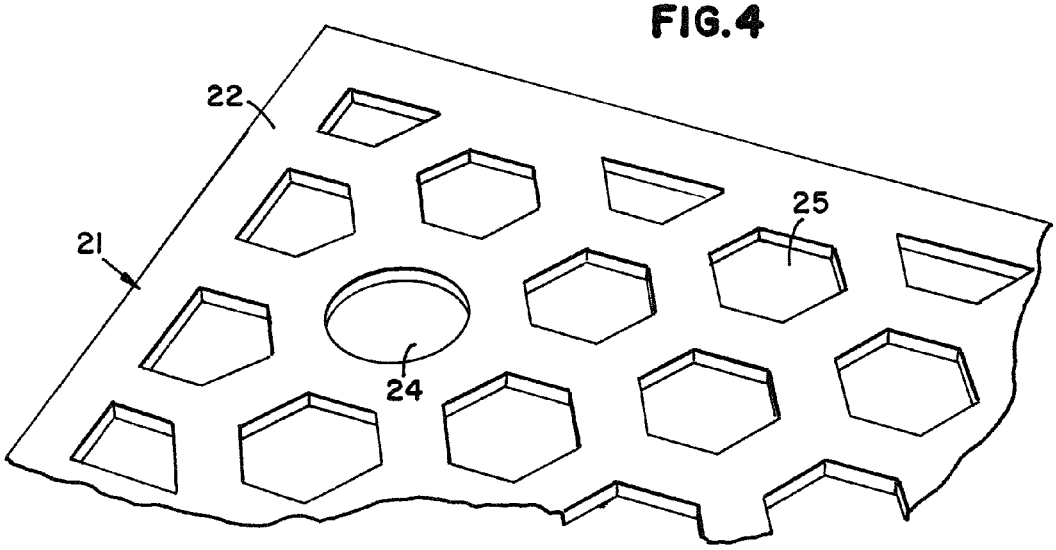
FIG. 4 is a top perspective view of a portion of the product carrier shown in FIG. 3.
Figure 6:
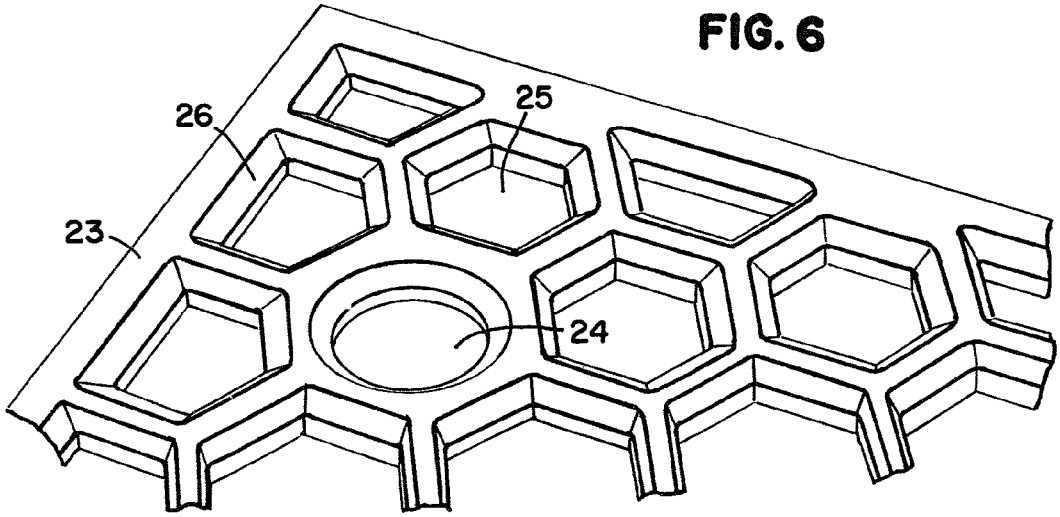
FIG. 6 is a bottom perspective view of a portion of the product carrier shown in FIG. 3.

The product carrier includes a first side 22 and a second side 23, which are shown in FIGS. 4 and 6, respectively. The first side 22 faces outward from the plate member 11 while the second side 23 faces the front side 12 of the plate member 11. A mating member 24, which engages the attachment member 15, is also included in the product carrier 21. In the preferred embodiment, the mating member 24 is a pair of holes having diameters of approximately ⅜ inch, one hole located on each side of the product carrier 21 and configured and arranged to releasably engage each of the hole plugs in the plate member 11 as described above. The holes could also be oval in shape to accommodate either round or square hole plugs, as shown in FIG. 11*a*, and the oval shape would ensure that the hole plugs would fit should any shrinkage of the holes occur from exposure to the heat of the dryer. A plurality of apertures 25 approximately ⅜ inch in diameter are arranged on the product carrier, and in the preferred embodiment, the plurality of apertures 25 are hexagon shaped and are arranged in a non-linear, honeycomb fashion. This nonlinear, honeycomb arrangement of the apertures 25 strengthens the product carrier 21 and prevents the product 31 from breaking and shearing from the product carrier 21. In addition, one preferred embodiment apertures 25 are countersunk or back beveled on the second side 23 to form a rivet like structure when the product 31 is applied to the product carrier 21. The apertures 25 may also be tapered from the first side 22 to the second side 23 rather than being countersunk. The countersunk portion 26 of apertures 25 allows the product 31 to be securely attached to the product carrier 21, as would a tapered aperture, and this is described more fully below. The product carrier 21 containing product 31 is disposable and replaceable once the product 31 has been depleted on the product carrier 21.

Figure 5:
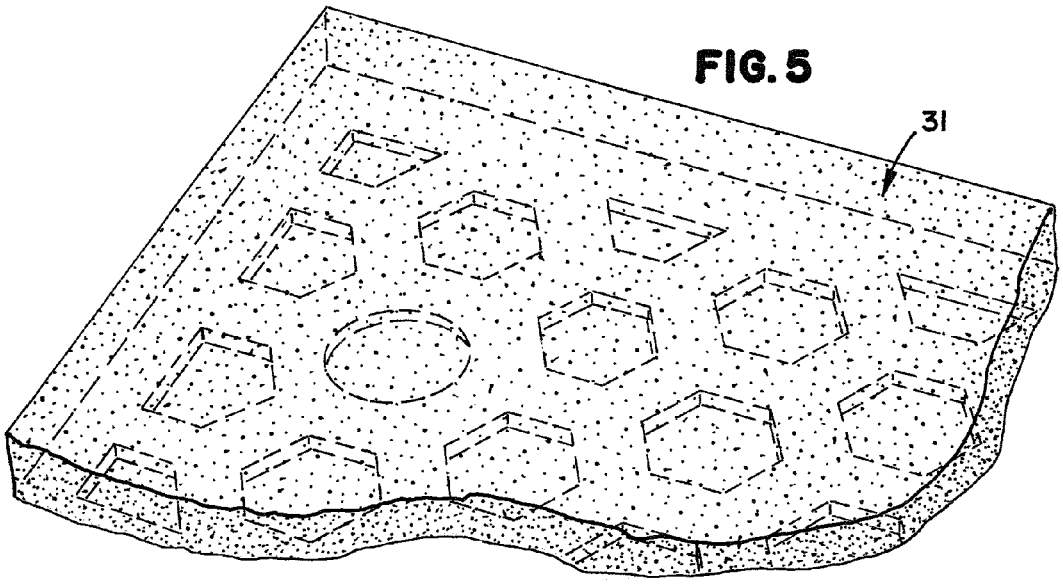
FIG. 5 is a top perspective view of the portion of the product carrier shown in FIG. 4 with product on the product carrier.

The product 31 is preferably a solid product that is cast or extruded onto the first side 22 of the product carrier 21, as shown in FIG. 5. The product 31 could also be glued, attached with VELCRO®, or otherwise operatively connected by means well known in the art to the product carrier 21. An example of how the product may be cast onto the product carrier is to obtain a heated vessel, a heated filler line, a filler mold with a top plate, and the product carrier. All the components of the product formula are heated in the vessel until a transparent homogeneous melt is formed. The product carrier is then inserted into the filler mold, and the filler mold is covered with the top plate which preferably features a pipe-shaped opening. The melted product is then poured through the pipe-shaped opening in the top plate into the filler mold until the filler mold is completely filled with product. The product is then allowed to cool within the filler mold. After cooling, the top plate is removed from the filler mold and the solid block of product operatively connected to the product carrier is removed from the filler mold.

An example of how the product may be extruded onto the product carrier is to use injection molding. First, a mold is created. The mold could be made with steel, aluminum, or any other suitable material known in the art. Typically, the mold includes two pieces forming a cavity, and an aperture, termed a gate, allows access to the cavity. The cavity is configured and arranged to receive and accept the product carrier and to provide a space or a pocket into which the product is injected. When the two pieces are closed to define the cavity, the molten product is injected into the cavity via the gate and then allowed to solidify within the mold. The product to be injected is first heated in a barrel and a screw pushes the product into the cavity of the mold through the gate. Following the injection process, the product within the mold is typically cooled by circulating water through the mold in cooling lines. At the end of the cooling cycle, the mold is opened and the solidified product and product carrier are ejected from the mold.

Figure 7:
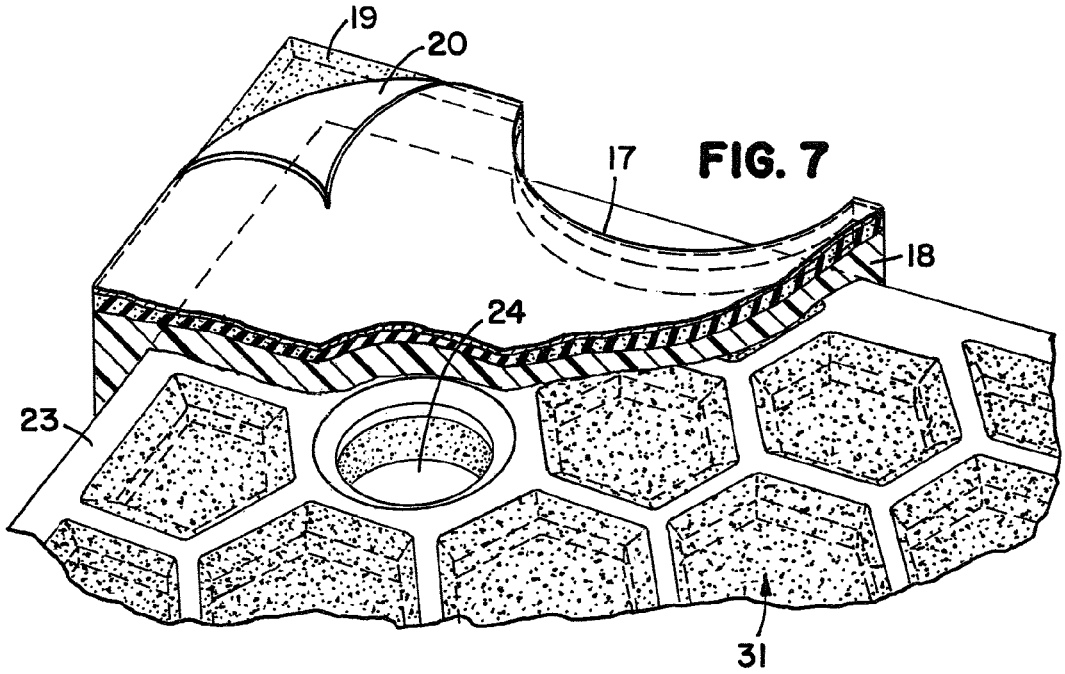
FIG. 7 is a bottom perspective view of the portion of the product carrier shown in FIG. 6 with product on the product carrier and the product dispenser attached thereto.

As the product 31 is being cast or extruded onto the first side 22 of the product carrier 21, the product 31 fills in the apertures 25, and the countersunk portions 26 of apertures 25 allow the product 31 to fan or spread out proximate the second side 23 of the product carrier 21. When the product 31 solidifies onto the product carrier 21, this fanning or spreading out of the product 31 in the countersunk portions 26 proximate the second side 23 holds the product 31 onto the first side 22 of the product carrier 21, as shown in FIG. 7. A substantial portion of the product 31 extends from the first side 22 of the product carrier 21 away from the plate member 11 and the second side 23 of the product carrier 21 faces the front side 12 of the plate member 11. The substantial portion being at least about 85% of the product 31 on the side of the carrier 21 from which the product 31 is dispensed. The product 31 extends approximately ¾ inch from the first side 22 of the product carrier 21. The preferred embodiment utilizes a solid fabric softener as the product 31 that is fixedly cast or extruded onto the product carrier 21. A solid fabric softener that may be used is described in U.S. patent application Ser. No. 10/120,891, filed Apr. 10, 2002, entitled Fabric Softener Composition and Methods for Manufacturing and Using, and U.S. patent application Ser. No. 10/656,854, filed Sep. 4, 2003, now U.S. Pat. No. 7,087,572, entitled Fabric Treatment Compositions and Methods for Treating Fabric in a Dryer, which are both incorporated by reference herein.

Figure 20:
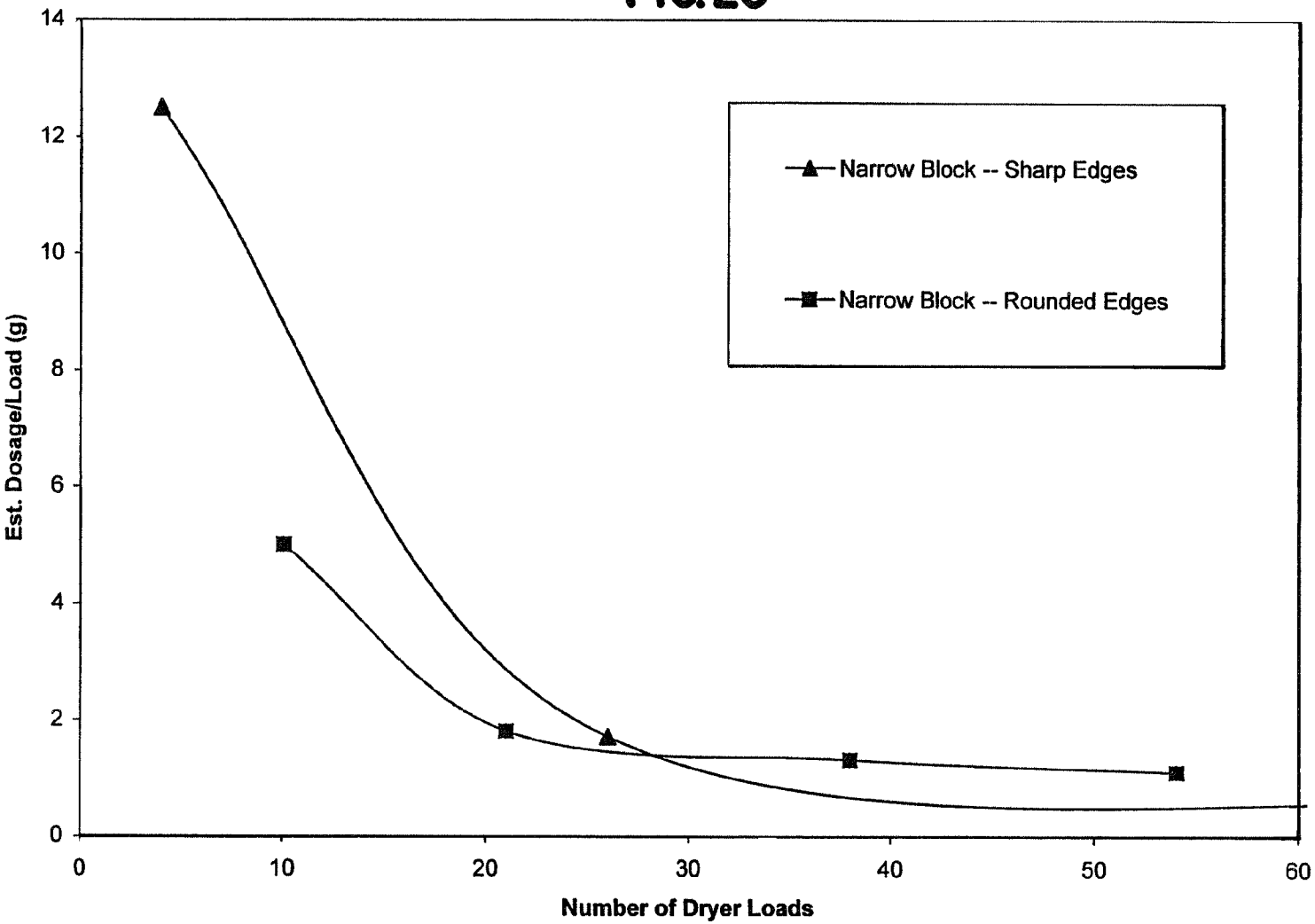
FIG. 20 is a graph showing the dispensing rates of the solid products shown in FIGS. 16*a* and 17*a;*
Figure 21:
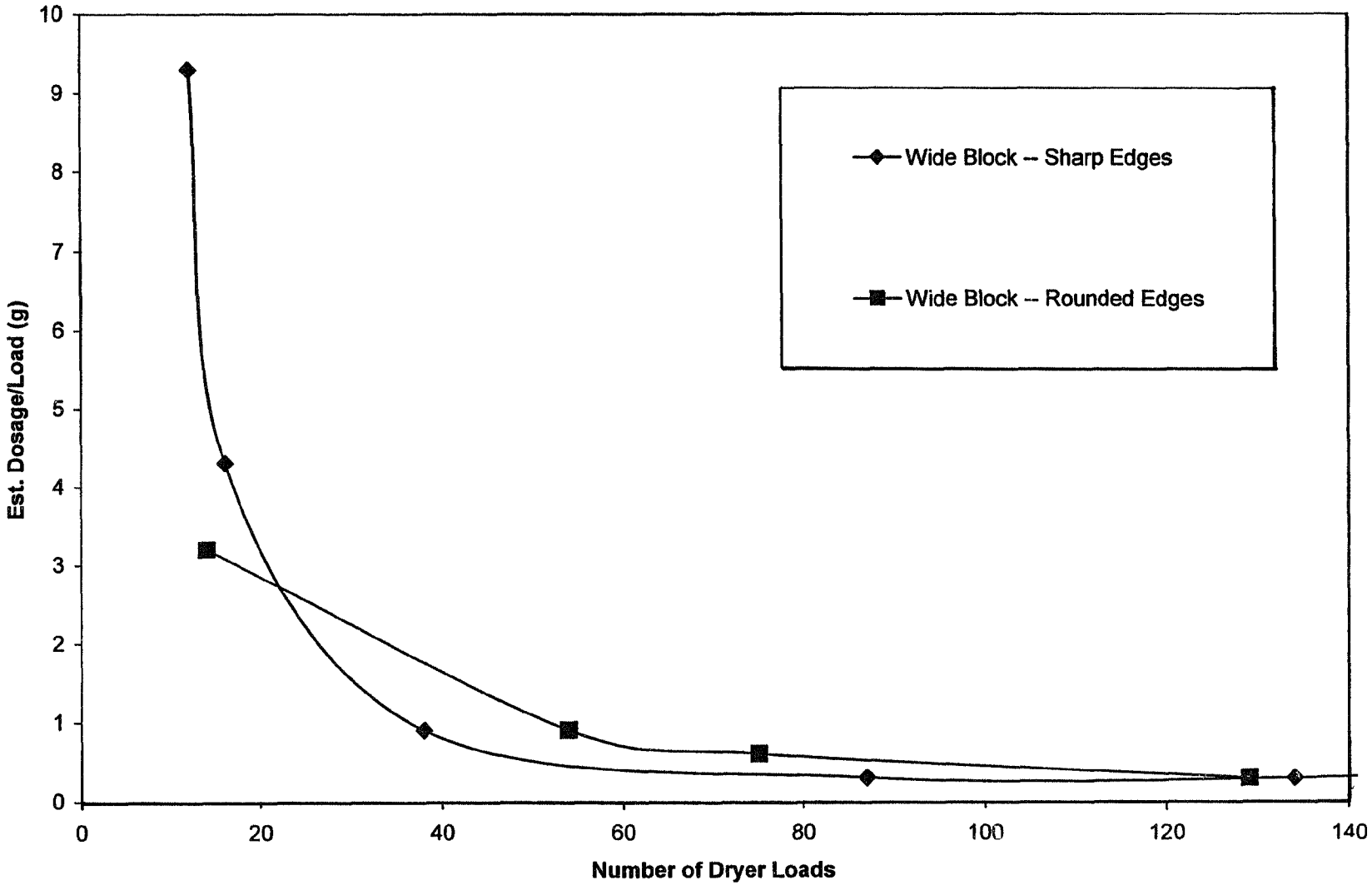
FIG. 21 is a graph showing the dispensing rates of the solid products shown in FIGS. 18*a* and 19*a;*

In operation, the paper 20 is peeled from the adhesive 19 operatively connected to the back side 18 of the plate member 11, and the adhesive 19 is applied to a surface such as a dryer fin 41 thereby operatively connecting the plate member 11 to the surface. Then, the product carrier 21 carrying product 31 is attached to the plate member 11. The attachment member 15 of the plate member 11 is configured and arranged to engage the mating member 24 of the product carrier 21. In the preferred embodiment, the attachment member 15 is a pair of holes on each side of the plate member 11 and the mating member 24 is a pair of hole plugs on each side of the product carrier 21 configured and arranged to releasably engage the holes. As described above, the hole plugs snap into the holes. When the product carrier 21 is attached to the plate member 11, the rail member 14 of the plate member 11 surrounds the edges and corners of the product carrier 21 thereby preventing items from getting caught or snagged on the edges and corners of the product carrier 21. The product 31 is then ready for dispensing. Only a small portion of the product 31 is depleted during each use. In the preferred embodiment fabric softener, approximately 1 to 3 grams of product is dispensed per cycle. Therefore, the product carrier 21 carrying the product 31 can be used for several applications. However, this amount of product will vary depending upon the type of product being dispensed, the chemical composition of the product, the size of the product, the size of the dryer, etc. Ideally, a consistent, optimum dose will be dispensed from the first cycle to the last cycle resulting in a relatively even dispense curve, as shown in FIGS. 20 and 21. When the product 31 becomes depleted, the empty product carrier 21 can be replaced with a second product carrier carrying product, and the empty product carrier 21 can be thrown away. Alternatively, the product carrier 21 could be removed if dispensing of the product 31 is not desired. If it is desired to removed the plate member 11 from the surface and if an adhesive similar to COMMAND™ Adhesive by 3M of St. Paul, Minn. is used as the connecting member, the tab may be pulled to release the adhesive thereby allowing easy removal of the plate member 11 from the surface.

In another preferred embodiment, shown in FIGS. 8 and 9, the product dispenser and carrier 110 includes a mount 111 and a product carrier 121. The mount 111 is made of a high melt point plastic as discussed previously and is generally wedge shaped having dimensions of approximately 9⅜ inches long by 2⅜ inches wide and the first end 116 is ¼ inch thick and the second end 117 is ⅜ inch thick. Therefore, an end view of the mount 111 resembles a generally triangular shape with one side being thicker than the other, opposing side, forming an angle of approximately 10 degrees. The angle may vary depending upon the product to be dispensed to maximize the even dispensing of the product. The front side 112 includes an attachment member 115, which is a flange, proximate the first end 116 and the second end 117. The back side 118 includes an adhesive 119, similar to the adhesive 19 of the previously mentioned preferred embodiment, with paper backing 120.

The product carrier 121 has a first side 122, a second side 123, a first end 116, and a second end 117. Also made of a high melt point plastic as discussed previously, the dimensions of the product carrier are approximately 9⅜ inches long by 2⅜ inches wide by 3/16 inch thick. It is recognized that the dimensions are for illustrative purposes only and any dimensions suitable for the intended purpose are acceptable. The product carrier 121 is an extruded plastic part with dove tail grooves along the length of the product carrier 121 on the first side 122. The dove tail grooves 125 are approximately ⅛ inch deep. The dove tail grooves 125 hold the product 131 onto the first side 122 of the product carrier 121, in a similar fashion as the countersunk portions 26 hold the product 31 onto the product carrier 21. Also included on the product carrier 121 is mating member 124, which is a leg extending from each of the edges running along the length of the product carrier 121 to engage the flange 115 of the mount 111. The legs can either snap onto the flanges or the product carrier 121 may be slid onto the mount 111 to operatively connect the components. The product 131 is similarly cast or extruded onto the first side 122 of the product carrier 121 and held in place by the dove tail grooves 125. Because the mount 111 is wedge shaped, the product 131 is disposed at an angle relative to the surface upon which the mount 111 is operatively connected to maximize the amount of product 131 dispensed and to ensure that the product 131 is dispensed evenly.

In operation, the paper is peeled from the adhesive 119 operatively connected to the bottom side 118 of the mount 111, and the adhesive 119 is applied to a surface such as a dryer fin 141 thereby operatively connecting the mount 111 to the surface. Then, the product carrier 121 carrying product 131 is attached to the mount 111. The attachment member 115 of the mount 111 is configured and arranged to engage the mating member 124 of the product carrier 121. In the preferred embodiment, the attachment member 115 is a flange on each end 116 and 117 of the mount 111 and the mating member 124 is a pair of legs on each side of the product carrier 121 configured and arranged to releasably engage the flanges. The product carrier 121 may be either snapped onto the mount 111 so the legs engage the flanges or the product carrier 121 may be slid onto the mount 111 from the end of the mount 111. The product 131 is then ready for dispensing. The wedge shape of the mount 111 allows the product 131 to be more evenly dispensed because the product 131 is angled toward the center of the dryer 140 thereby exposing a greater surface area of the product 131 to the laundry contained within the dryer 140. Again, only a small portion of the product 131 is depleted during each use. Therefore, the product carrier 121 carrying the product 131 can be used for several applications. When the product 131 becomes depleted, the empty product carrier 121 can be replaced with a second product carrier carrying product, and the empty product carrier 121 can be thrown away. Again, the product carrier 121 could be removed if dispensing of the product 131 is not desired. Again, if it is desired to removed the plate member 11 from the surface and if an adhesive similar to COMMAND™ Adhesive by 3M of St. Paul, Minn. is used as the connecting member, the tab may be pulled to release the adhesive thereby allowing easy removal of the plate member 11 from the surface.

In another preferred embodiment product dispenser and carrier 210, shown in FIGS. 11*a* and 11*b*, the dispenser 211 includes an attachment member 215, which is a pair of oval shaped holes. The oval shaped holes ensure that the corresponding hole plugs, whether round or square, fit within the holes even if shrinkage of the holes during casting of the product (approximately up to 300° F.) or from the dryer heat (approximately up to 250° F.) should occur. The dispenser 211 also includes a front 212, a back 218, and a perimeter 213. The perimeter 213 of the dispenser 211 includes a rail portion 214 extending outward from the front 212 and an indentation 217. The rail portion 214 borders the carrier 221 and protects the edges of the carrier 221 when operatively connected to the front 212 of the dispenser 211. The indentation 217 provides easy access to a portion of the edges of carrier 221 when detachment from the dispenser 211 is desired. An adhesive, not shown, may be attached to the back 218 of the dispenser 211 for attaching the dispenser 211 to a surface.

The carrier 221 includes a first side 222, a second side 223, and a mating member 224. The first side 222 is the side onto which a solid product is similarly cast or extruded, and the solid product extends outward from the first side 222. The first side 222 is dome shaped so that when the solid product is mounted thereto the solid product will take on a dome shape as well. In addition, the dome shape of the first side 222 creates deeper countersunk portions (not shown) proximate the second side 223 thereby allowing the product to attach more securely to the carrier 221. The dome shape also improves the dispense rate of the product and assists in more even dispensing of the product. Although not shown, the carrier 221 includes a plurality of apertures similar to those shown in FIGS. 13 and 14. This arrangement of the plurality of apertures allows the product to spread out from the first side 222 toward proximate the second side 223 thereby preventing the solid product from detaching from the carrier 221. The mating member 224 is a pair of square shaped hole plugs with arrow shaped ends and a slit parallel with the edges forming the arrow shaped ends. The mating member 224 corresponds with the holes in the dispenser 211. Because the hole plugs are square rather than round, there is more surface area engaging the holes thereby maximizing the grip. The hole plugs simply snap into the holes to releasably attach the carrier 221 to the dispenser 211.

Figure 12:
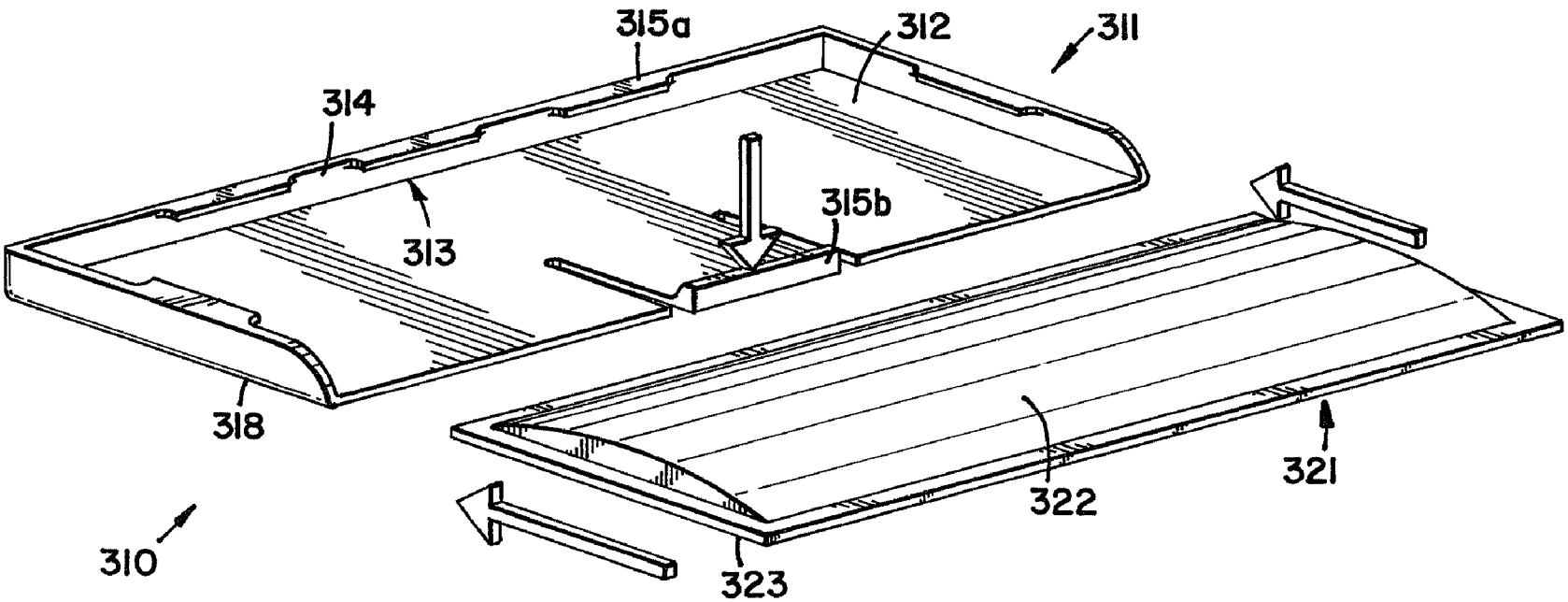
FIG. 12 is an exploded top perspective view of another embodiment product dispenser and carrier constructed according to the principles of the present invention.

FIG. 12 shows another preferred embodiment of the present invention. Rather than having an attachment member and a mating member that snap into one another, the product dispenser and carrier 310 includes a carrier 321 that slides into a dispenser 311. The carrier 321 itself acts as the mating member in this embodiment. The dispenser 311 has a front 312, a back 318, and a perimeter 313. The back 318 provides a surface on which an adhesive or other securing member may be attached to mount the product dispenser and carrier 310 onto a surface. The perimeter 313 of the dispenser 311 includes a rail portion 314 extending outward from the front 312 along three sides of the dispenser 311. The rail portion 314 borders the carrier 321 along three sides and protects the three edges of the carrier 321 when operatively connected to the front 312 of the dispenser 311. An attachment member includes lips 315*a* and a securing tab 315*b*. The lips 315*a* extend inward from the rail portion 314 to engage the three edges of the carrier 321 thereby preventing the carrier 321 from detaching from the dispenser 311. The securing tab 315*b* is on the fourth side of the dispenser 311 not having a rail portion. When the carrier 321 is slid into the dispenser 311 from the fourth side, the securing tab 315*b* is pushed downward and then snaps into place to border the corresponding edge of the carrier 321 when in place on the front 312 of the dispenser 311. Therefore, securing tab 315*b* provides a snap fit to hold the carrier 321 onto the dispenser 311. To disengage the carrier 321 from the dispenser 311, the securing tab 315*b* is pushed downward and then the carrier 321 is slid away from the dispenser 311 from the fourth side.

The second side 323 of the carrier 321 faces the front 312 of the dispenser 311 and the first side 322 of the carrier 321 is the side from which the product extends. Again, the first side 322 is dome shaped so that when the solid product is mounted thereto the solid product will take on a dome shape with rounded top edges as well. Again, this dome shape improves the dispensing rate of the product and assists in more even dispensing of the product. Although not shown, the carrier 321 includes a plurality of apertures similar to those shown in FIGS. 13 and 14. This arrangement of the plurality of apertures allows the product to spread out from the first side 322 toward proximate the second side 323 thereby preventing the solid product from detaching from the carrier 321.

Figure 13:
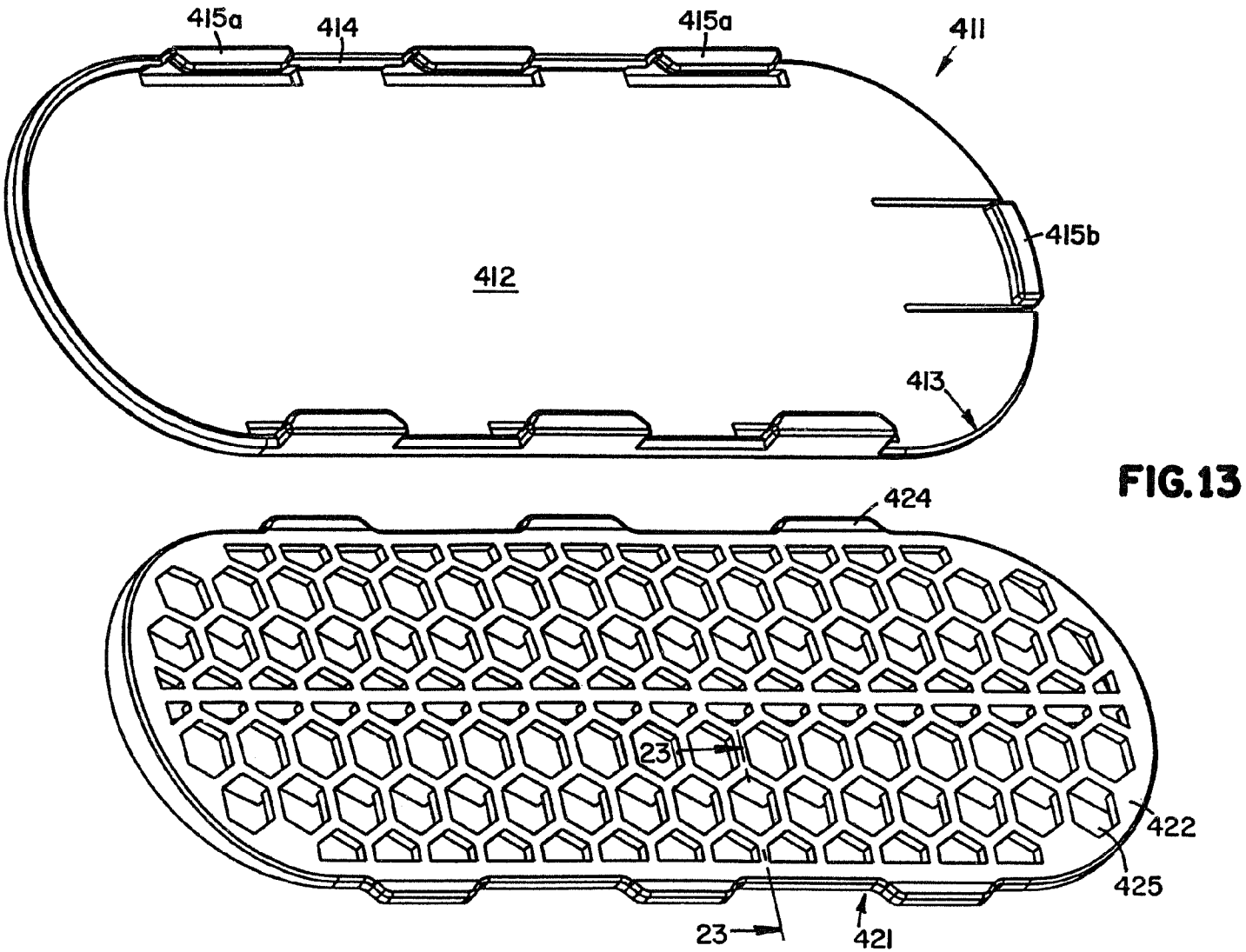
FIG. 13 is an exploded top perspective view of another embodiment product dispenser and carrier constructed according to the principles of the present invention.

FIG. 13 is another embodiment of the present invention similar to that shown in FIG. 12 but rather than sliding into the dispenser 411 from the side, the carrier 421 slides in from an end. The product dispenser and carrier 410 includes a dispenser 411 and a carrier 421. The dispenser 411 has a front 412 and a perimeter 413.

The perimeter 413 of the dispenser 411 includes a rail portion 414 extending outward from the front 412 along three sides of the dispenser 411, leaving an end without a rail portion. The rail portion 414 borders the carrier 421 along three sides and protects the corresponding three edges of the carrier 421 when operatively connected to the front 412 of the dispenser 411. An attachment member includes lips 415*a* and a securing tab 415*b*. The lips 415*a* extend from the rail portion 414 along the two sides, and in the preferred embodiment, there are three lips 415*a* on each side, the three lips 415*a* being aligned with the opposing three lips 415*a*. It is recognized, however, that any arrangement of lips 415*a* is possible as long as the mating members 424 on the carrier 421 are properly aligned. The securing tab 415*b* is on the end of the dispenser 411 not having a rail portion. When the carrier 421 is slid into the dispenser 411 from either the end or as described below, the securing tab 415*b* is pushed downward and then snaps into place to border the corresponding edge of the carrier 421 when in place on the front 412 of the dispenser 411.

The back (not shown) of the dispenser 411 provides a surface onto which an adhesive, magnet, or other attachment member may be attached to mount the dispenser 411 onto a surface. It is recognized that the attachment member may be attached to the entire back of the dispenser or a portion thereof. FIGS. 24*a* and 24*b* show embodiments having at least one magnet operatively connected to the back of the dispenser. The at least one magnet may be molded into the back in a channel-type setting thereby incorporating the magnet into the back of the dispenser, attached to the back of the dispenser with an adhesive, attached to the back of the dispenser with a fastener such as a screw, a pin, a stud, or a clamp. In FIG. 24*a*, a magnet 419' is incorporated into the back 418' of the dispenser and in FIG. 24*b*, two magnets 419" are incorporated into the back 418" of the dispenser. Any number of magnets may be operatively connected to the dispenser as long as the magnet(s) provide a strong enough attraction to the surface to hold the product dispenser and carrier in place during use.

The carrier 421 has a first side 422, a second side 423, and mating members 424. The mating members 424 are lips extending from the side edges of the carrier 421 and are arranged similarly as the lips 415*a* on the dispenser 411. Therefore, the carrier 421 does not have to be slid into the dispenser 411 all the way from an end of the carrier 421. Rather, the mating members 424 are simply placed in the spaces between the lips 415*a* thereby depressing the securing tab 415*b* concurrently. As the carrier 421 is slid into the dispenser 411 so that the lips 415*a* align with the mating members 424, the securing tab 415*b* engages the end of the carrier 421 thereby snap locking it into place. This provides a shorter distance to connect the carrier 421 to the dispenser 411 should the walls of the dryer prevent the carrier 421 from being slid into place from the end of the dispenser 411. To disengage the carrier 421 from the dispenser 411, the securing tab 415*b* is pushed downward and then the carrier 421 is slid away from the lips 415*a* of the dispenser 411. When the mating members 424 of the carrier 421 no longer align with the lips 415*a* of the dispenser 411, the carrier 421 may be removed from the dispenser 411.

The carrier 421 also includes a plurality of apertures 425 and tapered portions 426. The tapered portions 426 taper outward from the first side 422 to the second side 423 of the carrier 421, and the tapered apertures 425 have a smaller diameter on the first side 422 and a larger diameter on the second side 423. The preferred embodiment apertures 425 are hexagonal shaped, and each of the six sides is tapered. In the preferred embodiment, the tapered portions 426 are angled more than 0° and less than 10° from a tangent line generally perpendicular to the first side 422 of the carrier 421. More preferably, the tapered portions 426 are tapered approximately 1° to 3° from a tangent line generally perpendicular to the first side 422 of the carrier 421. FIG. 23 shows a cross sectional view of an aperture 425 in the carrier 421 taken along the lines 23-23 in FIG. 13. The apertures 425 have tapered portions 426 with angles A. Similar to the countersunk portions described above, angles A provide means to secure the solid product onto the carrier 421 because the solid product slightly fans out proximate the second side 423 thereby securing the solid product onto the carrier 421.

In any of the embodiments, either tapered portions or countersunk portions may be used as they have the same function. The tapered portions begin at the top of the carrier and taper outward toward the bottom of the carrier. In the countersunk portions, the taper begins approximate the middle of the carrier and taper outward toward the bottom of the carrier. Regardless where the taper begins, the taper allows the solid product to fan out proximate the bottom of the carrier thereby securing the solid product onto the carrier.

Figure 14:
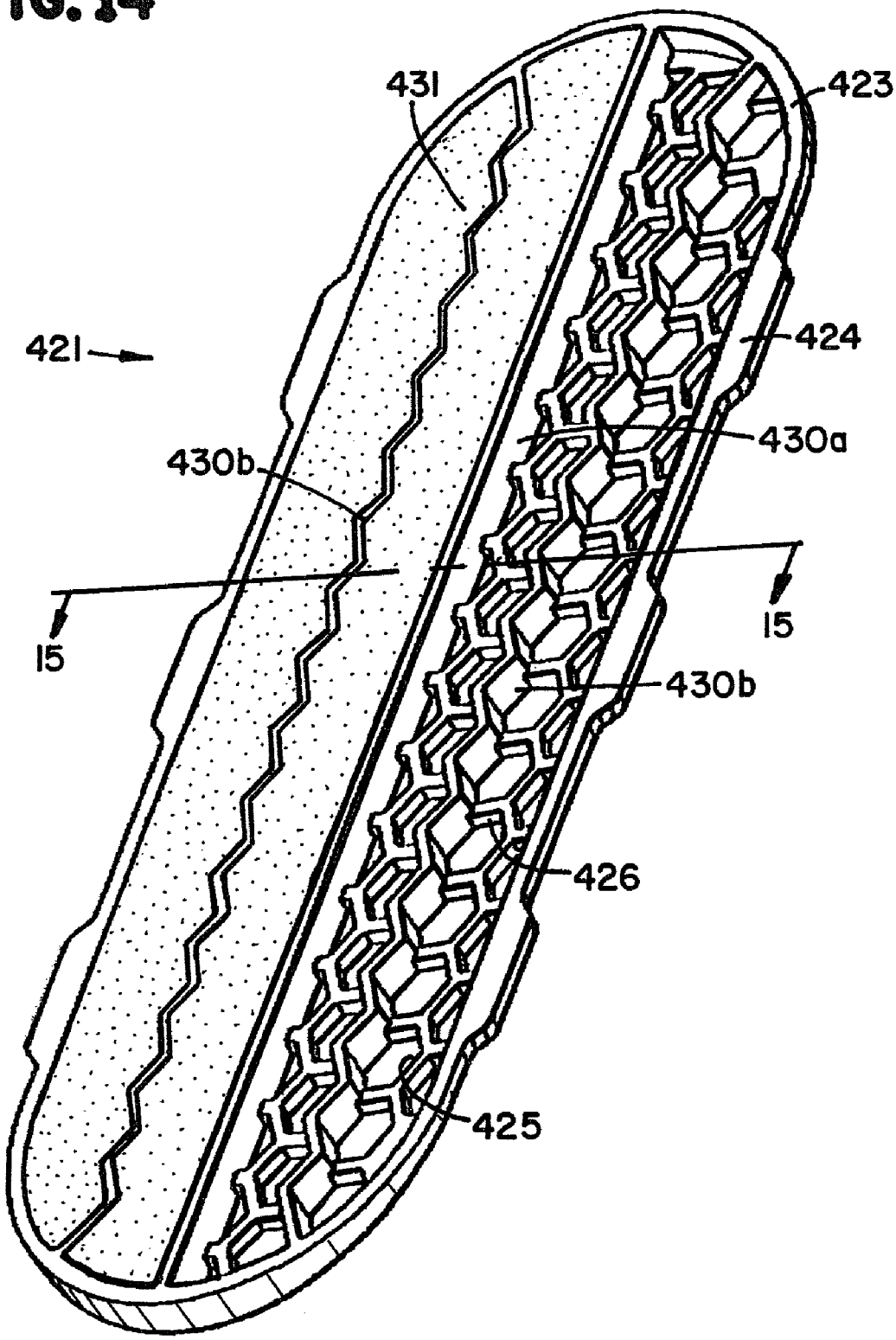
FIG. 14 is a bottom perspective view of the carrier shown in FIG. 13 with a product operatively connected to half of the carrier.

FIG. 14 is a bottom perspective view of the carrier 421 shown in FIG. 13. For illustrative purposes, product 431 is only shown on half of the carrier 421 to show both the bottom structure of the carrier 421 and how the product 431 is supported below the carrier 421. As shown in FIG. 14, the carrier 421 includes a straight reinforcement rib member 430*a* along the center parallel to the sides of the carrier 421 and a zig-zag reinforcement rib member 430*b* on each side of the straight reinforcement rib 430*a* approximately half-way to the sides of the carrier 421. The zig-zag reinforcement members 430*b* do not interfere with the nonlinear arrangement of the apertures 425 and therefore do not block the apertures 425. The zig-zag reinforcement members 430*b* may or may not be tapered or countersunk to hold the product in a similar way as the apertures 425 of the carrier 421. There is a major portion of the product 431 on the top of the carrier 421 to be dispensed during the dryer cycle. There is a minor portion of the product 431 inside the carrier 421 and extending into the tapered portions 426 and in between the ribs 430*a* and 430*b* of the carrier 421, as shown in FIG. 14. Therefore, the major portion of the product is joined on top of the carrier 421 and the minor portion of the product is joined below the carrier 421 between the ribs 430*a* and 430*b*. This assists in keeping the product on the carrier 421.

Figure 15:
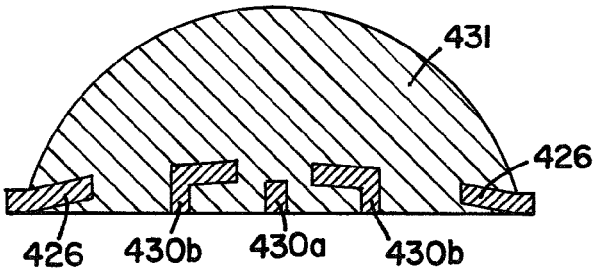
FIG. 15 is a cross sectional view of a solid product on the product carrier taken along the line 15-15 of FIG. 14.

Optionally, the carrier 421 may also include a cover (not shown) attached to the second side 423 and creating a gap between the second side 423 and the cover where the product joins below the carrier 421. With a cover, the product 431 would contact the cover between the ribs 430*a* and 430*b*. This assists in casting the product vertically onto the carrier 421 and the product is more evenly applied to the carrier 421. When casting the product onto the carrier 421 horizontally, the cover is not needed for even application of the product. Also, the cover protects the solid product that has gone through the apertures and tapered portions so the only part of the product that is exposed is the portion extending from the first side 422 of the carrier 421. Therefore, the product can extend past the tapered portions 426 and reconnect/join along the surface of the cover to provide additional assurance that the product will not separate from the carrier 421. The line 15-15 in FIG. 14 shows the line across which the cross sectional view of FIG. 15 is taken. FIG. 15 is a cross sectional view showing a solid product 431 on the carrier 421 shown in FIGS. 13 and 14. Although FIG. 14 shows product 431 on only half of the carrier 421, FIG. 15 shows product on the entire carrier 421. This further shows how the product 431 connects both above and below the carrier 421 for added security of the product 431 on the carrier 421.

Figure 22:
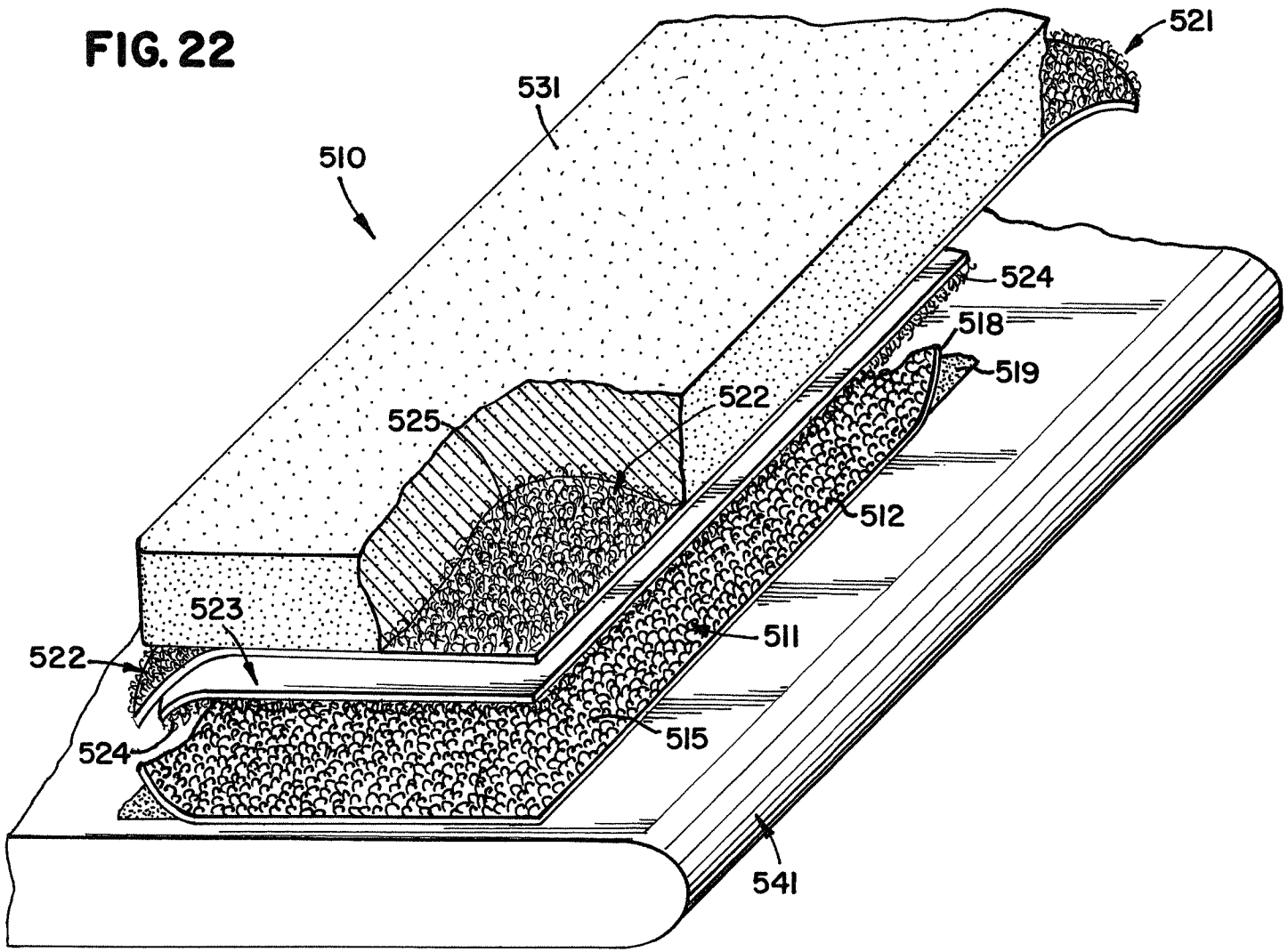
FIG. 22 is an exploded side perspective view of another embodiment product dispenser and carrier constructed according to the principles of the present invention.

In addition, the product could also be mounted, cast, extruded, or otherwise attached by means well known in the art onto VELCRO®, 3M™ Scotchmate™, 3M™ Dual Lock™, or any other suitable hook and loop or reclosable fastener type device. FIG. 22 shows a preferred embodiment product dispenser and carrier 510 utilizing hook and loop. The product dispenser and carrier 510 includes a dispenser or plate member 511 and a carrier 521. The dispenser 511 is a piece of loop having a front 512 with an attachment member 515 and a back 518 with an adhesive or connecting member 519. The adhesive 519 operatively connects the dispenser 511 onto a surface such as a dryer fin 541. The carrier 521 includes a first side or layer 522 and a second side or layer 523. The first and second sides 522 and 523 are each pieces of hook, and the adhesives attached to the back of each piece (not shown) are pressed together so that the hook portions are opposing. The first side 522 has hook 525 and the second side 523 has hook or mating member 524. The product 531 is attached to the hook 525 while the mating member 524 engages the attachment member 515. Therefore, the carrier 521 readily attaches to and detaches from the dispenser 511 as easily as the interaction between the hook 524 and the loop 515. When the product 531 has become depleted, the carrier 521 is simply detached from the dispenser 511 by disengaging the hook 524 and the loop 515 and then another carrier carrying product is substituted therefor.

Figure 25:
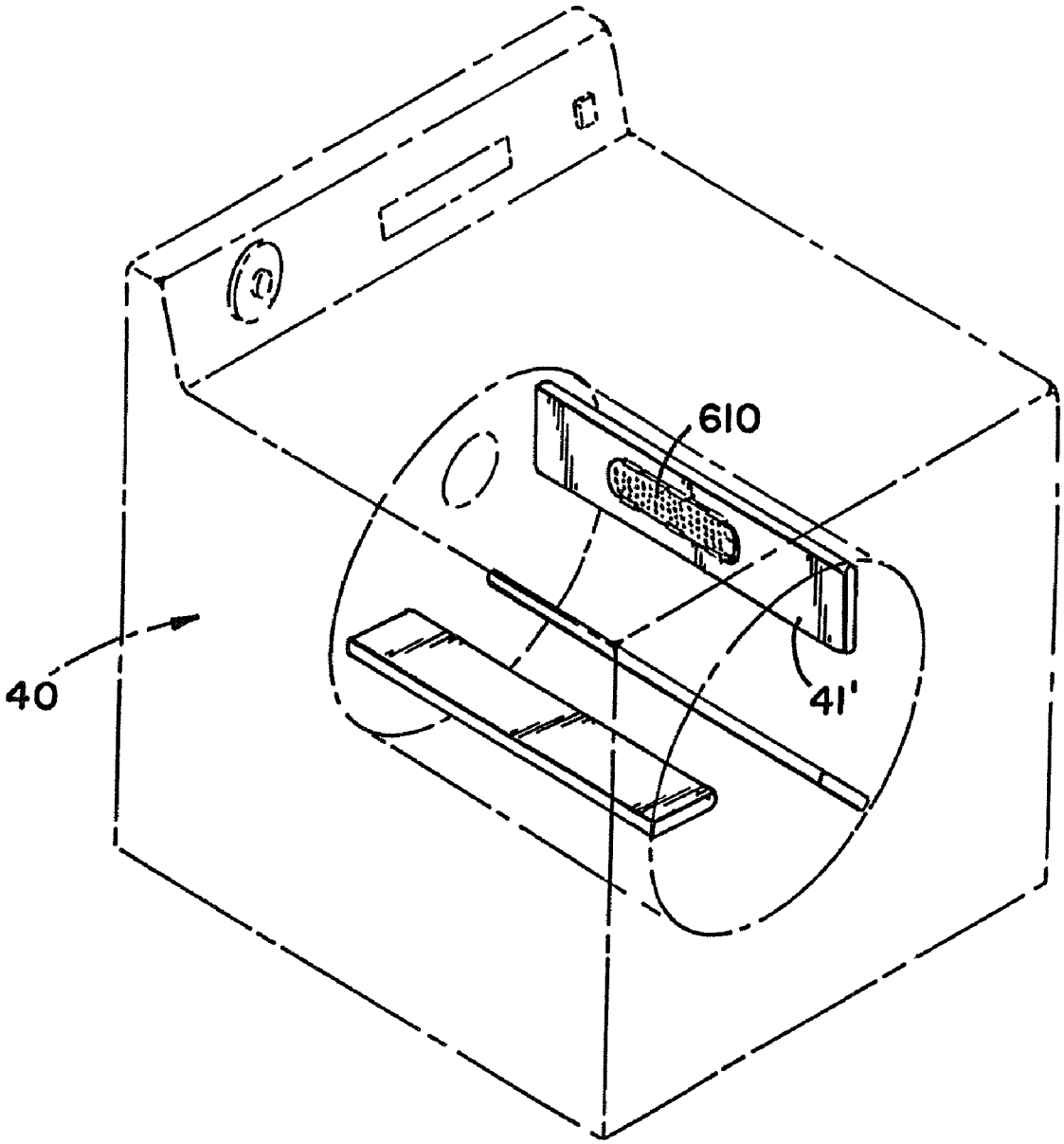
FIG. 25 shows another embodiment product dispenser and carrier constructed according to the principles of the present invention operatively connected to a dryer fin.

Another embodiment of the present invention incorporates the dispenser or plate member 611 of the product dispenser and carrier 610 into an inner surface of the dryer 40. The plate member may be molded as part of the inner surface of the dryer 40 or fixedly attached thereto by means well known in the art. FIG. 25 shows the dispenser 611 incorporated into the fin 41' of the dryer 40. However, the inner surface of the dryer could be a fin, a door, a wall opposite the door, and a drum wall of the dryer; and there are many possible locations and orientations of the plate member on these surfaces.

Figure 26:
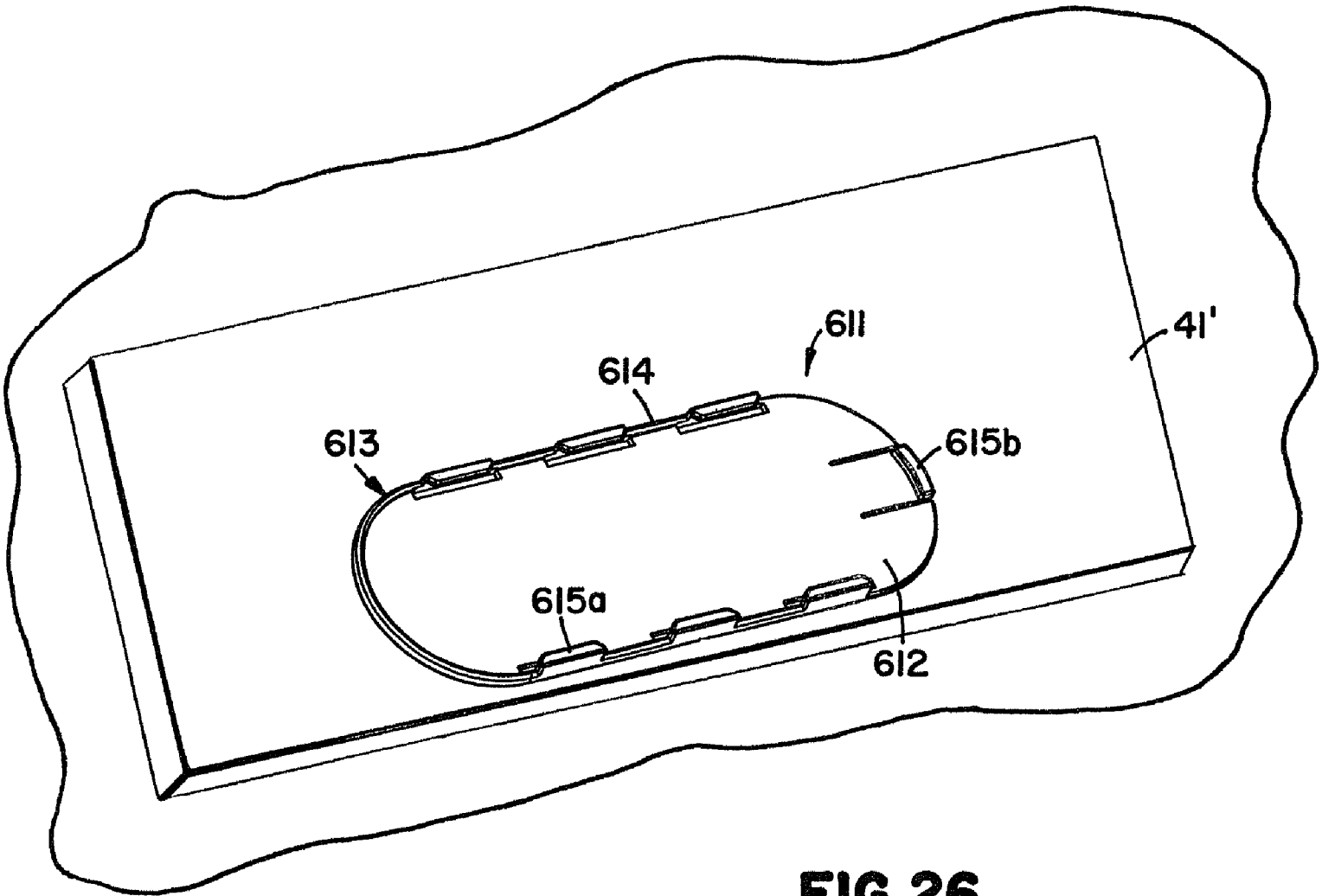
FIG. 26 is a top perspective view of a dispenser of the product dispenser and carrier of FIG. 25 incorporated into the dryer fin.

As shown in FIG. 26, the dispenser 611 of the product dispenser and carrier 610 includes a front side 612 and a perimeter 613. The perimeter 613 of the dispenser 611 includes a rail portion 614 extending outward from the front 612 along three sides of the dispenser 611, leaving an end without a rail portion. Alternatively, rather than having a rail portion, one end could include a stop member and the opposite end could receive the product carrier (not shown). Similar to the product dispenser and carrier 410 shown in FIG. 13, the rail portion 614 borders the product carrier along three sides and protects the corresponding three edges of the product carrier when operatively connected to the front 612 of the dispenser 611. An attachment member includes lips 615*a* and a securing tab 615*b*. The lips 615*a* extend from the rail portion 614 along the two sides, and in the preferred embodiment, there are three lips 615*a* on each side, the three lips 615*a* being aligned with the opposing three lips 615*a*. It is recognized, however, that any arrangement of lips 615*a* is possible as long as the mating members on the carrier (not shown) are properly aligned. The securing tab 615*b* is on the end of the dispenser 611 not having a rail portion. When the carrier is slid into the dispenser 611 from either the end or as described above with regard to the product dispenser and carrier 410, the securing tab 615*b* is pushed downward and then snaps into place to border the corresponding edge of the carrier when in place on the front 612 of the dispenser 611.

Although only one embodiment of the present invention is shown incorporated into the dryer fin 41', it is recognized that any of the embodiments shown and described could be similarly incorporated or even fixedly attached thereto. In addition, attachment members could simply be incorporated into the inner surface of the dryer to receive and secure the product carrier onto the inner surface.

Figure 16A:
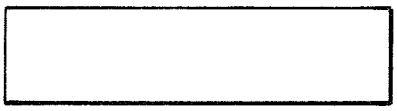
FIG. 16*a* is a side view of a solid product having a half-cylindrical narrow shape and a high dome.
Figure 16B:
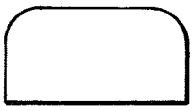
FIG. 16*b* is an end view of the solid product shown in FIG. 16*a;*
Figure 17A:
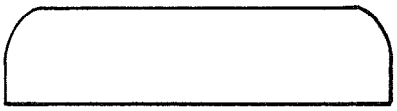
FIG. 17*a* is a side view of a solid product having a half-cylindrical narrow shape and a high dome with rounded top edges.
Figure 17B:
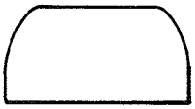
FIG. 17*b* is an end view of the solid product shown in FIG. 17*a;*
Figure 18A:
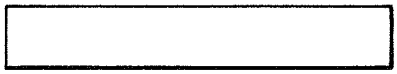
FIG. 18*a* is a side view of a solid product having a half-cylindrical wide shape and a low dome.
Figure 18B:
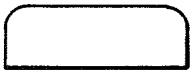
FIG. 18*b* is an end view of the solid product shown in FIG. 18*a;*
Figure 19A:
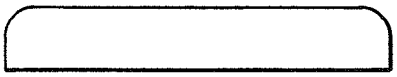
FIG. 19*a* is a side view of a solid product having a half-cylindrical wide shape and a low dome with rounded top edges.
Figure 19B:
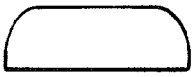
FIG. 19*b* is an end view of the solid product shown in FIG. 19*a;*

It was found that the shape of the product affects the dispensing rate of the product. The dispense curves of the product dose per dryer cycle as a function of the number of dryer cycles were compared for four different sizes and shapes of solid product. Each solid product was 8 inches long. The dispenser and carriers were mounted in the center on the front portion of the fin of a 75 pound dryer. The front portion of the fin is the portion that touches the laundry. The first product having a half-cylindrical narrow shape (1.75 inches wide) and a high dome (1.00 inch high) is shown in FIGS. 16*a* and 16*b*. FIG. 16*a* is a side view of the product and FIG. 16*b* is an end view of the product shown in FIG. 16*a*. The second product having a half-cylindrical narrow shape (1.75 inches wide) and a high dome (1.00 inch high) with rounded top edges is shown in FIGS. 17*a* and 17*b*. FIG. 17*a* is a side view of the product and FIG. 17*b* is an end view of the product shown in FIG. 17*a*. The third product having a half-cylindrical wide shape (2.50 inches wide) and a low dome (0.65 inch high) is shown in FIGS. 18*a* and 18*b*. FIG. 18*a* is a side view of the product and FIG. 18*b* is an end view of the product shown in FIG. 18*a*. The fourth product having a half-cylindrical wide shape (2.50 inches wide) and a low dome (0.65 inch high) with rounded top edges is shown in FIGS. 19*a* and 19*b*. FIG. 19*a* is a side view of the product and FIG. 19*b* is an end view of the product shown in FIG. 19*a*.

The wide, low dome products (third and fourth products) shown in FIG. 21 dispensed the product more slowly than the narrow, high dome products (first and second products) shown in FIG. 20. The initial doses were approximately 9 grams and 3.5 grams per dryer cycle (third and fourth products, respectively) versus approximately 13 grams and 5 grams per dryer cycle (first and second products, respectively). The products with the rounded top edges (second and fourth products) dispensed the product more evenly from the first to the last cycle as compared to the products with squared/sharp edges (first and third products). In other words, the high initial doses observed with squared/sharp edges (first and third products) were avoided by rounding the edges (second and fourth products). These high initial doses are most likely due to the wet laundry sliding over the square/sharp edges at both ends of the half-cylindrical product thereby slowly wearing the edges until a rounded edge is formed. The optimum shape for even dispensing of the product was obtained by using a half-cylindrical block of product with squared/sharp edges that were rounded after approximately 20 dryer cycles. Therefore, starting with a shape having rounded edges or rounded surfaces, which results from using a block of product with squared/sharp edges that were rounded after approximately 20 dryer cycles, provides an optimum shape for dispensing a consistent, optimum dose of product. The optimum shape helped reduce high product doses in the initial doses. As shown in FIGS. 20 and 21, the most even dispensing was achieved with the wide product block with rounded edges (fourth product).

FIG. 20 is a graph showing the dispensing rates of the solid products shown in FIGS. 16*a* and 17*a*, and FIG. 21 is a graph showing the dispensing rates of the solid products shown in FIGS. 18*a* and 19*a*. These graphs show that products having rounded edges have more even dispense curves from the first dose to the final dose. The products having the sharp edges begin with much higher initial doses than products having rounded edges. Therefore, to ensure that a consistent, optimum dose is achieved for each cycle, a product with rounded edges should be used.

The amount of product dispensed is also moisture controlled. In other words, every time the wet or damp laundry tumbling around in the dryer contacts the product, minute amounts of the product are dissolved by the adsorbed water in the laundry. This is due to the low water solubility of the product and also due to the friction (mechanical action) of the laundry rubbing against the product. Once the laundry is dry, product will no longer be dispensed. In the preferred embodiment, the product is sized to deliver doses for multiple cycles (100+). Ideally, the dose should not change significantly from the first to the last dryer cycle. For example, if a dose of 1 gram per cycle provides the desired effect on the laundry, a block of 100 grams should last for 100 cycles, dispensing approximately 1 gram per cycle. Generally, the product will last for multiple cycles (100+) in a dryer and dispense approximately the same dose of product from the first to the last cycle.

However, experiments have shown that dispense curves are not even from the first to the last cycle because of the changes in volume, surface area, and shape of the product over time. The changes in the volume and the surface area, which inevitably decrease with each dose, cause the dispensed dose to decrease slowly from the first to the last cycle because there is less contact with the laundry and the product. The shape of the product is also a factor for the initial doses of the product. If the product is cast in the shape of a rectangular block, the contact between the tumbling laundry and the block will cause the sharp edges of the block to become smooth or round by friction during the initial cycles. This causes substantially higher dispense doses in the initial dryer cycles until the edges are smooth or round and the block resembles a half-cylinder with round ends (oval in shape).

In addition, the amount of product that is dispensed can also be affected by the location, the position, and the orientation of the product in the dryer. The product can be placed on either side of the fin or even on the door of the dryer. In addition, it was found that placement of the dispenser and carrier on the fin also affects the dispensing rate of the product. In other words, placing the dispenser and carrier on the side of the fin that touches the laundry would increase the dispensing rate of the product. Conversely, placing the dispenser and carrier on the side opposite the side of the fin that touches the laundry would decrease the dispensing rate of the product. Position on the fin such as in the center of the fin or near the edge of the fin will also affect the dose. In addition, if the product is mounted at an angle relative to the surface of the fin, as shown in FIG. 9, more product is exposed to the laundry thereby dispensing more product. Although any of these placements is acceptable, it is preferred to place the dispenser and carrier on the back side of the fin (the following edge) to dispense less product, which provides better results.

As stated previously, the product carrier is operatively connected to the plate member. It is understood that the product carrier may be operatively connected to the plate member via various types of mating members and/or attachment members, including molding the product dispenser and carrier as one integral piece. In such an embodiment, the mating members and/or attachment members are the interconnecting portions operatively connecting the product carrier to the plate member.

Figure 27:
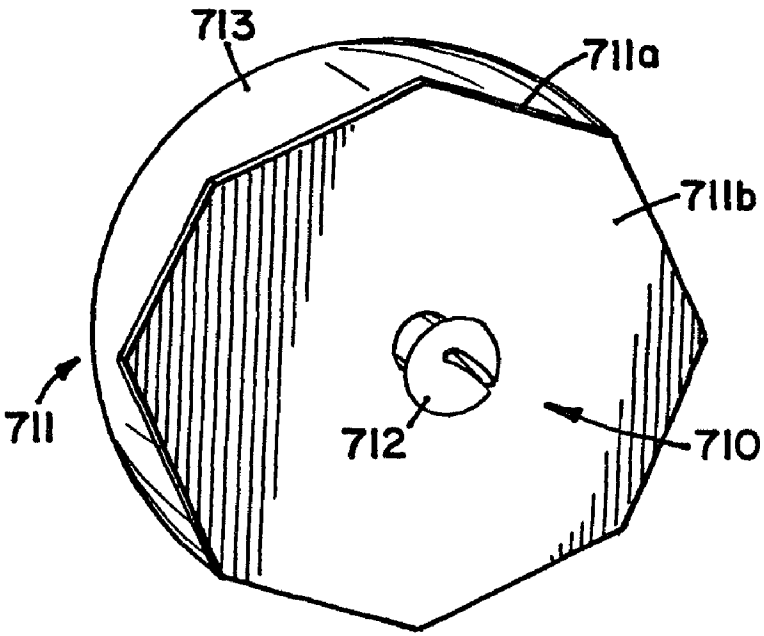
FIG. 27 is a back perspective view of another embodiment product dispenser and carrier constructed according to the principles of the present invention.

A preferred embodiment product dispenser and carrier 710 of an integral construction is shown in FIG. 27. The product dispenser and carrier 710 includes an octagonal dispenser member 711 having a product carrier 711*a* and a plate member 711*b*. The product carrier 711*a* provides a surface upon which a product 713 is operatively connected. The product 713 could be operatively connected to the product carrier 711*a* via a plurality of apertures, dove tail grooves, hooks, or other suitable devices well known in the art. For this and subsequent embodiments to be described, the previous embodiments described herein provide examples of possible constructions of the product carrier 711*a*. The plate member 711*b* provides a surface upon which a connecting member 712 is operatively connected for connecting the plate member 711*b* to a surface. The connecting member 712 is preferably a hole plug configured and arranged to engage a ventilation hole on the inner surface of a dryer, but it is recognized that other connecting devices well known in the art could be used such as, but not limited to, VELCRO®, a screw, a magnet, and an adhesive. The dispenser member 711 is preferably octagonal in shape, but other shapes may be used.

Figure 28:
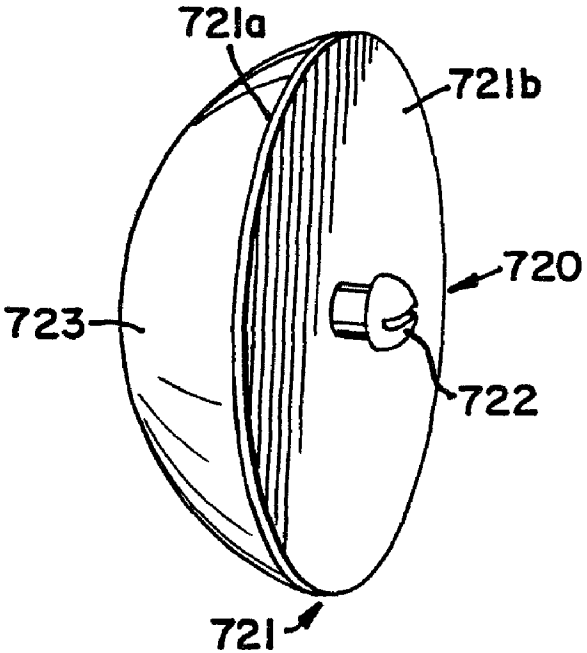
FIG. 28 is a back perspective view of another embodiment product dispenser and carrier constructed according to the principles of the present invention.

A preferred embodiment product dispenser and carrier 720 of an integral construction is shown in FIG. 28. The product dispenser and carrier 720 includes a round dispenser member 721 having a product carrier 721*a* and a plate member 721*b*. The product carrier 721*a* provides a surface upon which a product 723 is operatively connected. The product 723 could be operatively connected to the product carrier 721*a* via a plurality of apertures, dove tail grooves, hooks, or other suitable devices well known in the art. The plate member 721*b* provides a surface upon which a connecting member 722 is operatively connected for connecting the plate member 721*b* to a surface. The connecting member 722 is preferably a hole plug configured and arranged to engage a ventilation hole on the inner surface of a dryer, but it is recognized that other connecting devices well known in the art could be used such as, but not limited to, VELCRO®, a screw, a magnet, and an adhesive. The dispenser member 721 is preferably round in shape, but other shapes may be used.

Figures 29, 30, 31:
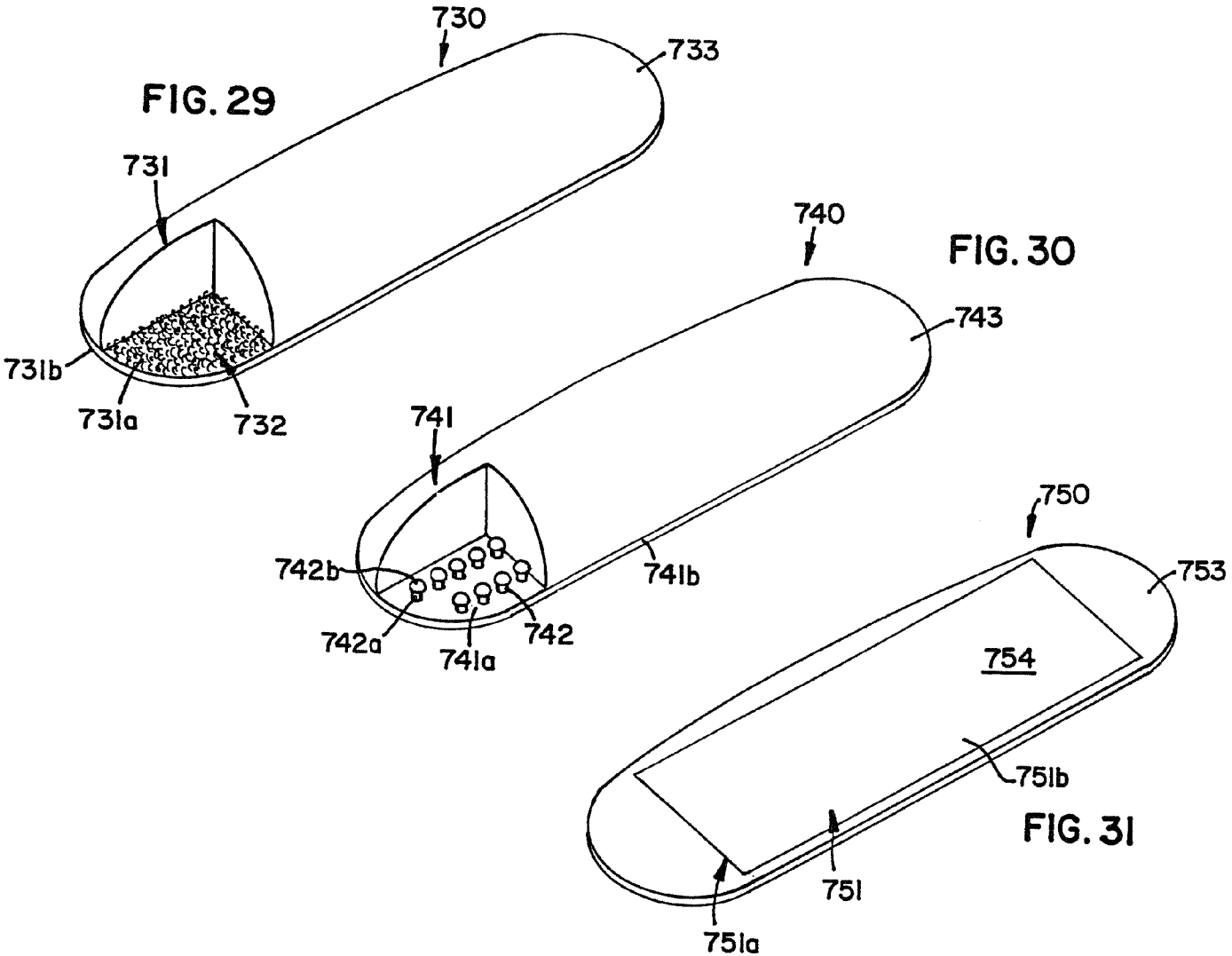
FIG. 29 is a front perspective view of another embodiment product dispenser and carrier constructed according to the principles of the present invention with a portion of product removed.
FIG. 30 is a front perspective view of another embodiment product dispenser and carrier constructed according to the principles of the present invention with a portion of product removed.
FIG. 31 is a back perspective view of another embodiment product dispenser and carrier constructed according to the principles of the present invention.

A preferred embodiment product dispenser and carrier 730 of an integral construction is shown in FIG. 29. The product dispenser and carrier 730 includes an oblong dispenser member 731 having a product carrier 731*a* and a plate member 731*b*. The product carrier 731*a* includes hooks 732 to which a product 733 is operatively connected, but it is recognized that other suitable devices well known in the art could be used to connect the product 733 to the product carrier 731*a*. The product 733 is cast or extruded onto the product carrier 731*a* and solidifies around the hooks 732. A portion of the product 733 has been removed to reveal the hooks 732. The plate member 731*b* provides a surface upon which a connecting member (not shown in this embodiment but has been fully described with respect to other embodiments) is operatively connected for connecting the plate member 731*b* to a surface. Suitable connecting members include, but are not limited to, a hole plug, VELCRO®, a screw, a magnet, and an adhesive. The dispenser member 731 is preferably oblong in shape, but other shapes may be used.

A preferred embodiment product dispenser and carrier 740 of an integral construction is shown in FIG. 30. The product dispenser and carrier 740 includes an oblong dispenser member 741 having a product carrier 741*a* and a plate member 741*b*. The product carrier 741*a* includes grips 742 to which a product 743 is operatively connected, but it is recognized that other suitable devices well known in the art could be used to connect the product 743 to the product carrier 741*a*. The grips 742 are preferably pin-shaped with a head 742*b* proximate the top of the pin 742*a*. The product 743 is cast or extruded onto the product carrier 741*a* and solidifies around the grips 742. The heads 742*b* are enlarged to hold the product 743 thereto. A portion of the product 743 has been removed to reveal the grips 742. The plate member 741*b* provides a surface upon which a connecting member (not shown) is operatively connected for connecting the plate member 741*b* to a surface. Suitable connecting members include, but are not limited to, a hole plug, VELCRO®, a screw, a magnet, and an adhesive. The dispenser member 741 is preferably oblong in shape, but other shapes may be used.

A preferred embodiment product dispenser and carrier 750 of an integral construction is shown in FIG. 31. The product dispenser and carrier 750 includes a rectangular dispenser member 751 having a product carrier 751*a* and a plate member 751*b*. The dispenser member 751 is preferably double sided tape, and the product carrier 751*a* includes tape (not shown in this embodiment but has been fully described with respect to other embodiments) to which a product 753 is operatively connected and the plate member 751*b* includes tape 754 for connecting the plate member 751*b* to a surface. The dispenser member 751 is preferably rectangular in shape, but other shapes may be used.

Figure 32:
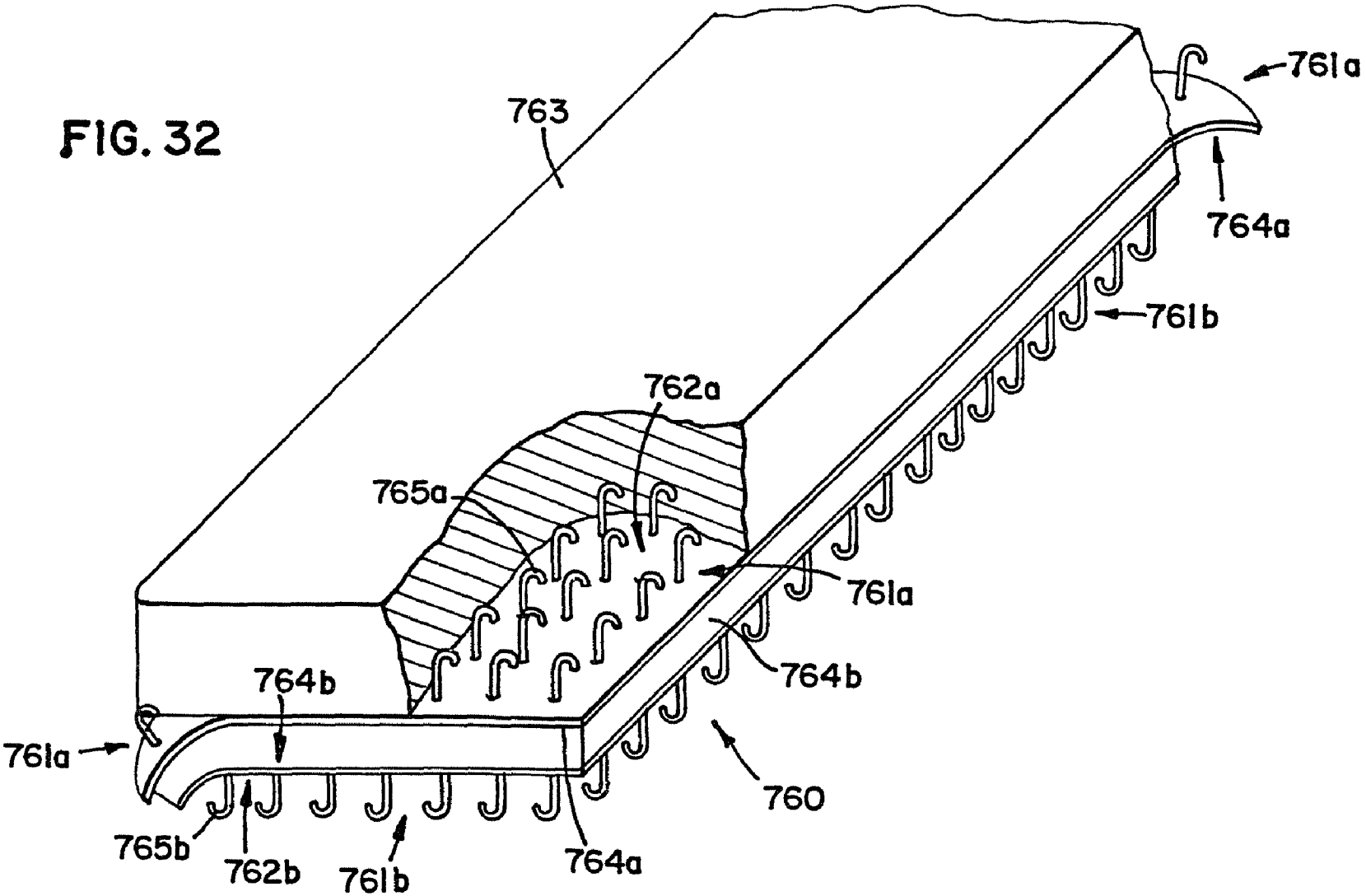
FIG. 32 is a front perspective view of another embodiment product dispenser and carrier constructed according to the principles of the present invention with a portion of product removed.

A preferred embodiment product dispenser and carrier 760 of an integral construction is shown in FIG. 32. The product dispenser and carrier 760 includes a dispenser member 761 having a product carrier 761*a* and a plate member 761*b*, each preferably having a hook side 762*a* and 762*b* and a backing 764*a* and 764*b*, respectively. The backings 764*a* and 764*b* face one another and are operatively connected by stitching, glue, tape, or other connecting devices well known in the art, and the hook sides 762*a* and 762*b* are opposing. Alternatively, one layer of double sided hook could be used rather than two layers of single sided hook. Hook side 762*a* provides a surface upon which a product 763 may be operatively connected. The product 763 is preferably cast or extruded onto the hook side 762*a* and solidifies about the hooks 765*a*. The hooks 765*b* are curved, bent, or looped to hold the product 763 thereto. The hook side 762*b* is configured and arranged to operatively connect to loop, a towel, or other suitable object that will connect to hooks 765*b*.

Figure 33:
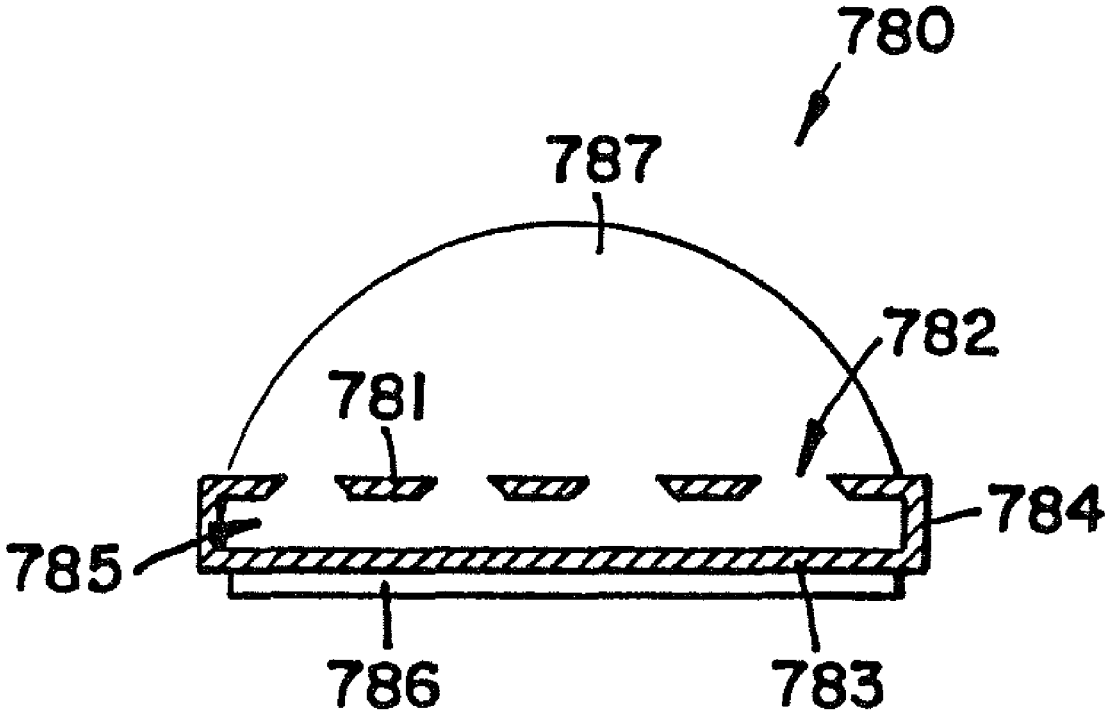
FIG. 33 is a cross-section of another embodiment product dispenser and carrier constructed according to the principles of the present invention.

Another preferred embodiment product dispenser and carrier 780 of an integral construction is shown in FIG. 33. The product dispenser and carrier 780 is preferably a one piece rectangular tube including a product carrier 781 and a plate member 783, which are interconnected by attachment or mating members 784 along the two sides of the product dispenser and carrier 780. A cavity 785 is between the product carrier 781 and the plate member 783. The product carrier 781 includes apertures 782 providing access to the cavity 785 and through which product 787 extends. The apertures are preferably countersunk or tapered to hold the product 787 therein. A connecting member 786 such as a magnet or other suitable member well known in the art is operatively connected to the plate member 783 to connect the plate member 783 to a surface.

Figure 34:
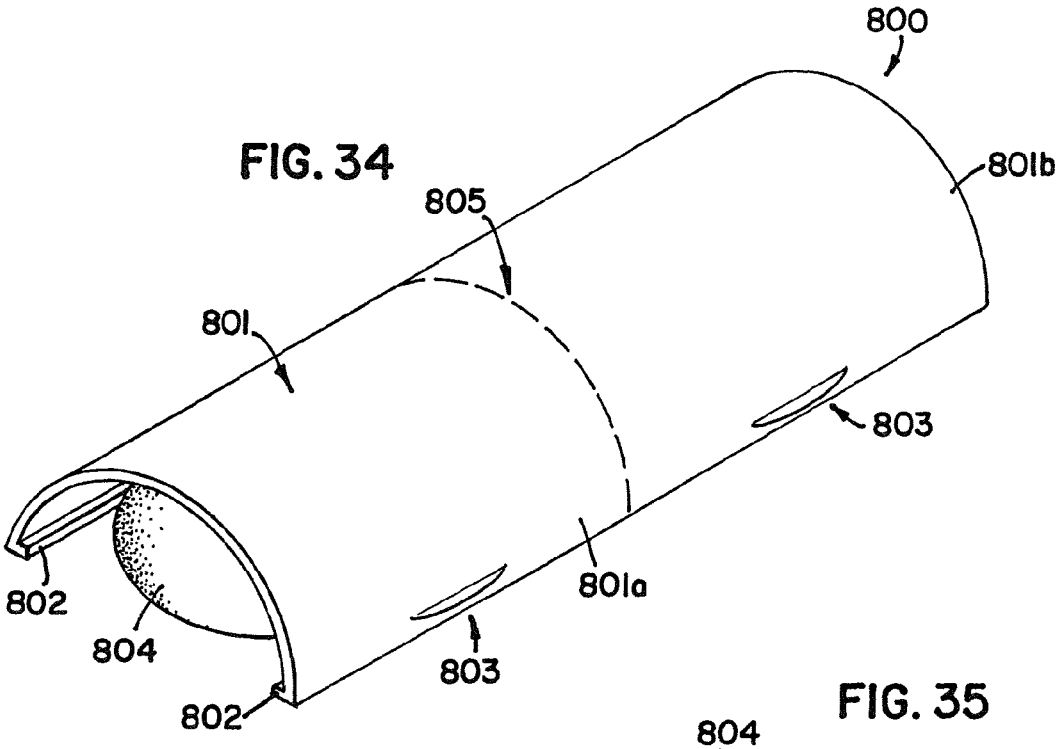
FIG. 34 is a front perspective view of another embodiment product dispenser and carrier constructed according to the principles of the present invention including a cover.
Figure 35:
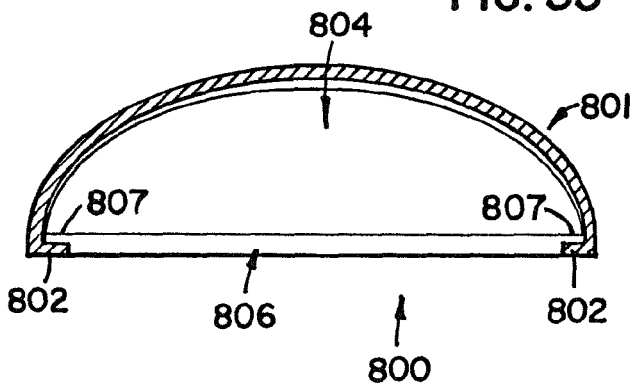
FIG. 35 is a cross-section of the product dispenser and carrier shown in FIG. 34.
Figure 36:
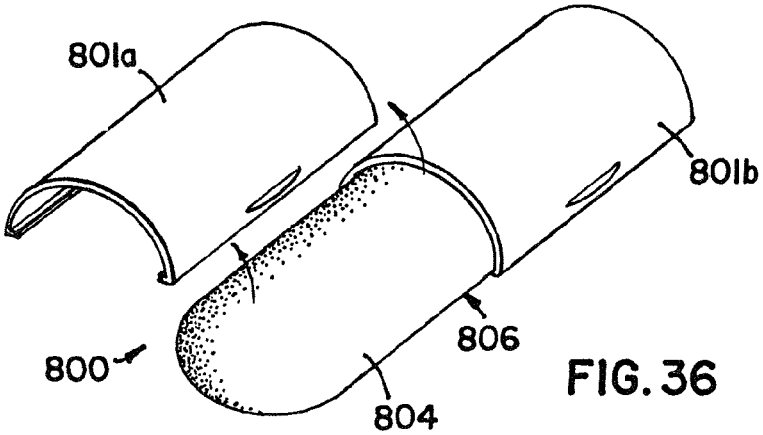
FIG. 36 is a front perspective view of the product dispenser and carrier shown in FIG. 34 with part of the cover removed.

As discussed previously, the amount of product dispensed can be affected by many factors. One way to assist in controlling the product dose is to provide a cover, which can be adjusted to expose varying amounts of product. The more product that is exposed, the higher the dose. Conversely, the less product that is exposed, the lower the dose. A preferred embodiment product dispenser and carrier 800 is shown in FIGS. 34-36. The product dispenser and carrier 800 includes a dispenser member 806 and a cover 801. The dispenser member 806 includes snap fit ledges 807 along the sides. The cover 801 is preferably a curved member includes lips 802 along the sides, and the lips 802 are configured and arranged to snap into place along the snap fit ledges 807, as shown in FIG. 35. The cover 801 releasably engages the dispenser member 806. Therefore, the cover 801 may be added or removed from the dispenser member 806. The cover 801 also includes a first half 801*a* and a second half 801*b*. Between the halves 801*a* and 801*b* is a perforated line 805, along which the cover 801 may be broken to expose half of the product 804. The halves 801*a* and 801*b* also include pulls 803 for assisting in removing the respective halves 801*a* and 801*b* from the dispenser member 806. FIG. 36 shows first half 801*a* being removed to expose one half of the product 804. Although the cover 801 is shown with two halves or sections, any number of sections could be used. If it is desired to dispense a lot of product 804, the entire cover 801 could be removed. If it is desired to dispense no product 804, the entire cover 801 could be added. If a smaller amount of product 804 to be dispensed is desired, either of the halves 801*a* and 801*b* could be removed.

Figure 37:
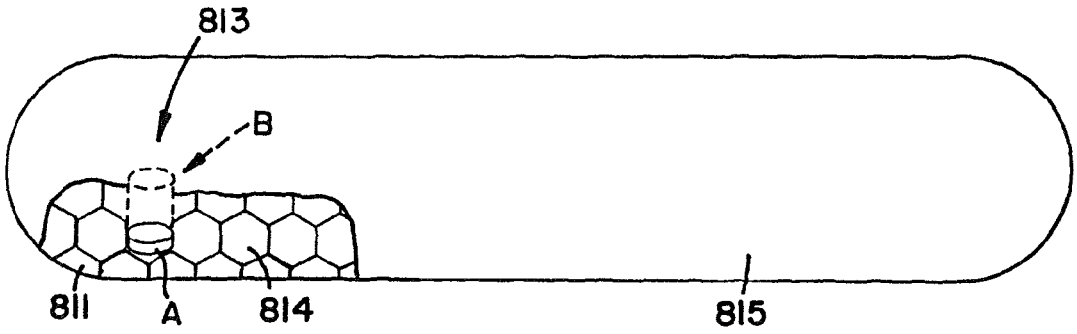
FIG. 37 is a top view of another embodiment product dispenser and carrier constructed according to the principles of the present invention with a portion of product removed to expose an out of product indicator.
Figure 38:
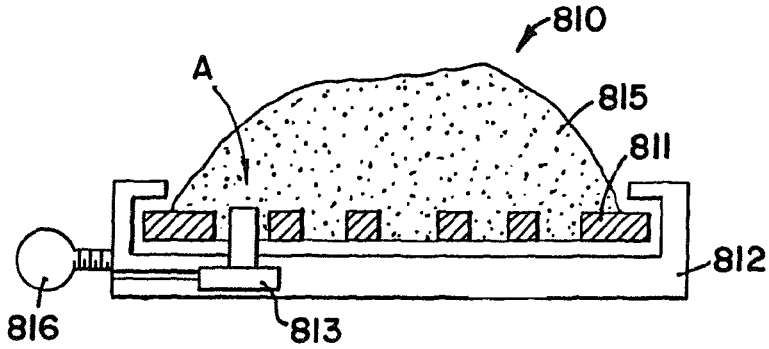
FIG. 38 is a cross-section of the product dispenser and carrier shown in FIG. 37 with the out of product indicator in a first position.
Figure 39:
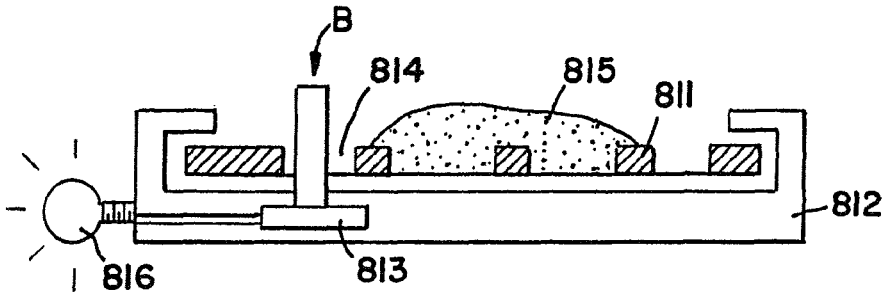
FIG. 39 is a cross-section of the product dispenser and carrier shown in FIG. 37 with the out of product indicator in a second position.

Because the product dispenser and carrier provides for replaceable product, an out of product indicator could be used to indicate when the product should be replaced. A preferred embodiment out of product indicator 813 for use with product dispenser and carrier 810 is shown in FIGS. 37-39. The product dispenser and carrier 810 includes a product carrier 811 and a plate member 812. The product carrier 811 includes apertures 814 configured and arranged to hold product 815 therein, and product 815 extends upward from one side of the product carrier 811. The plate member 812 engages the product carrier 811 on the side opposite the product 815 and includes the out of product indicator 813. The out of product indicator 813 is housed within the plate member 812 preferably proximate the side of the plate member 812 and extends into an aperture 814. The out of product indicator 813 is preferably a switch having a first position A and a second position B. FIG. 37 shows these two positions A and B. The out of product indicator 813 is operatively connected to an indicator 816, which is preferably a light extending from the plate member 812 where it is preferably visible. When the product is full, as in FIG. 38, the out of product indicator 813 is compressed and in the first position A because product 815 provides a downward force upon the out of product indicator 813. As the product 815 becomes depleted, the downward force is weakened until the product 815 becomes so low it cannot keep the out of product indicator compressed any longer. The out of product indicator 813 moves to the second position B, as shown in FIG. 39, which activates the indicator 816. The indicator 816 provides visual indication that the product 815 should be removed and replaced. In addition to or in lieu of a light, a beeper could be used to give an audible indication.

Figure 40:
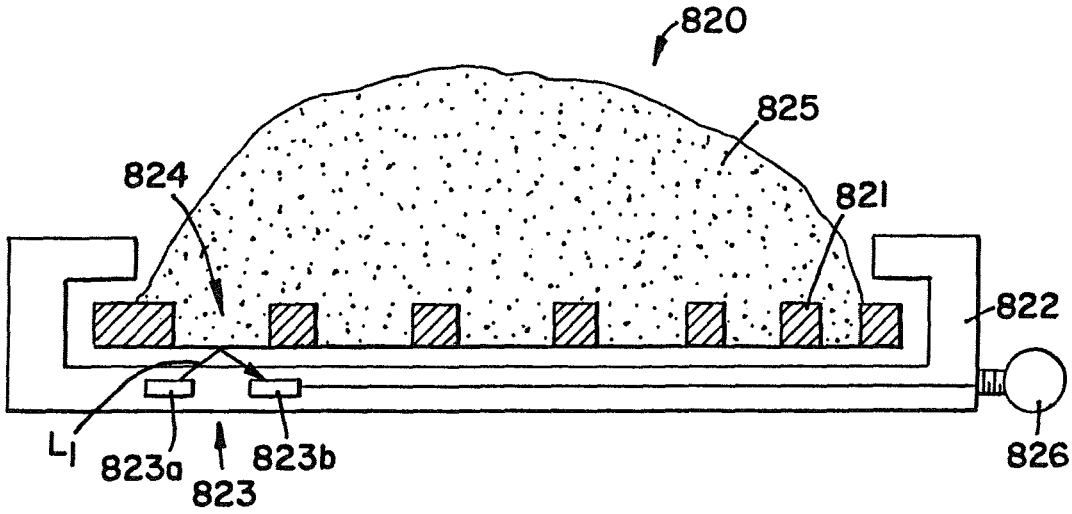
FIG. 40 is a cross-section of another embodiment product dispenser and carrier constructed according to the principles of the present invention including an out of product indicator having a first light beam.
Figure 41:
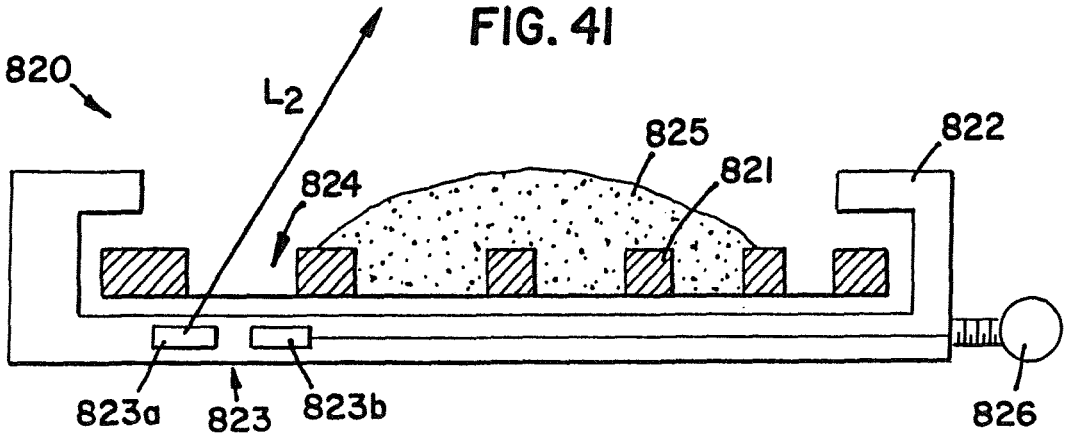
FIG. 41 is a cross-section of another embodiment product dispenser and carrier constructed according to the principles of the present invention including an out of product indicator having a first light beam.

A preferred embodiment out of product indicator 823 for use with product dispenser and carrier 820 is shown in FIGS. 40-41. The product dispenser and carrier 820 includes a product carrier 821 and a plate member 822. The product carrier 821 includes apertures 824 configured and arranged to hold product 825 therein, and product 825 extends upward from one side of the product carrier 821. The plate member 822 engages the product carrier 821 on the side opposite the product 825 and includes the out of product indicator 823. The out of product indicator 823 is housed within the plate member 822 preferably proximate the side of the plate member 822 and an aperture 824. The out of product indicator 823 is preferably a light emitting diode (hereinafter "LED") 823*a* and a photodiode 823*b*, the LED 823*a* providing a light beam and the photodiode 823*b* being operatively connected to an indicator 826, which is preferably a light extending from the plate member 822 where it is preferably visible. When the product is full, as in FIG. 40, the LED 823*a* provides light having a light path L1, which reflects off the product 825 in aperture 824 to the photodiode 823*b*, which keeps the indicator 826 turned off. As the product 825 becomes depleted and there is little to no product 825 within the aperture 824, the LED 823*a* provides light having a light path L2, which goes through the aperture 824. Therefore, the light path L2 does not reflect off the product 825 to the photodiode 823*b* and the photodiode 823*b* turns the indicator 826 on. The indicator 826 provides visual indication that the product 825 should be removed and replaced. In addition to or in lieu of a light, a beeper could be used to give an audible indication.

Figure 42:
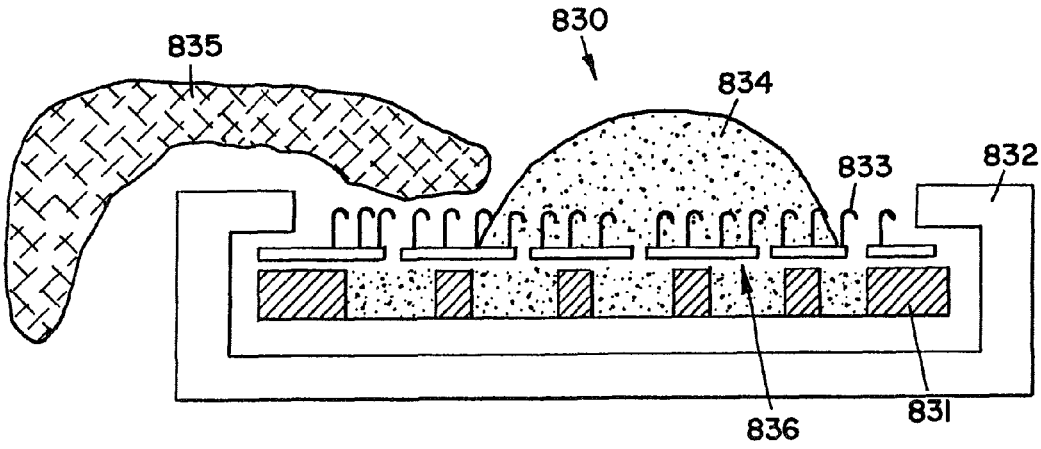
FIG. 42 is a cross-section of another embodiment product dispenser and carrier constructed according to the principles of the present invention including an out of product indicator.

A preferred embodiment out of product indicator 833 for use with product dispenser and carrier 830 is shown in FIG. 42. The product dispenser and carrier 830 includes a product carrier 831 carrying a product 834 and a plate member 832. The out of product indicator 833 is preferably a piece of hook proximate the top of the product carrier 831 where the product 834 enters the apertures 836. As the product 834 becomes depleted the hook becomes exposed. Preferably, the hook is either small pieces or includes apertures to allow the product 834 through the backing of the hook and into the apertures 836. When an area of hook large enough to attract and adhere to linen 835, the product 834 should be replaced.

Figure 43:
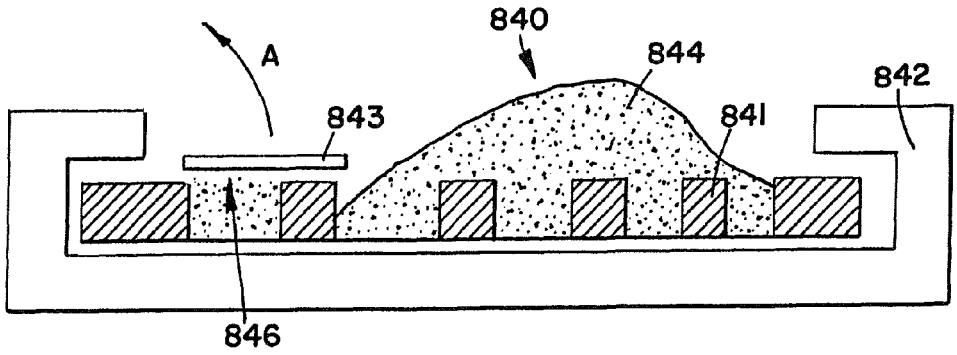
FIG. 43 is a cross-section of another embodiment product dispenser and carrier constructed according to the principles of the present invention including an out of product indicator.

A preferred embodiment out of product indicator 843 for use with product dispenser and carrier 840 is shown in FIG. 43. The product dispenser and carrier 840 includes a product carrier 841 carrying a product 844 and a plate member 842. The out of product indicator 843 is preferably a piece of foil or other easily recognizable material well known in the art proximate the top of the product carrier 841 where the product 844 enters the apertures 846. As the product 844 becomes depleted the foil loosens and eventually falls off the product carrier 841. Preferably, the foil is either small pieces or includes apertures to allow the product 844 through the foil and into the apertures 846. When the foil falls off, the product 844 should be replaced.

Figure 44:
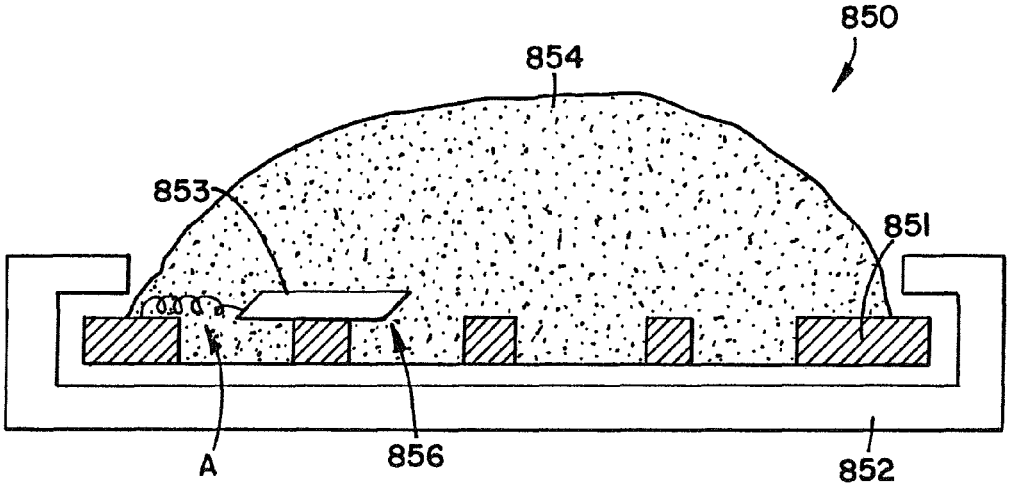
FIG. 44 is a cross-section of another embodiment product dispenser and carrier constructed according to the principles of the present invention including an out of product indicator in a first position.
Figure 45:
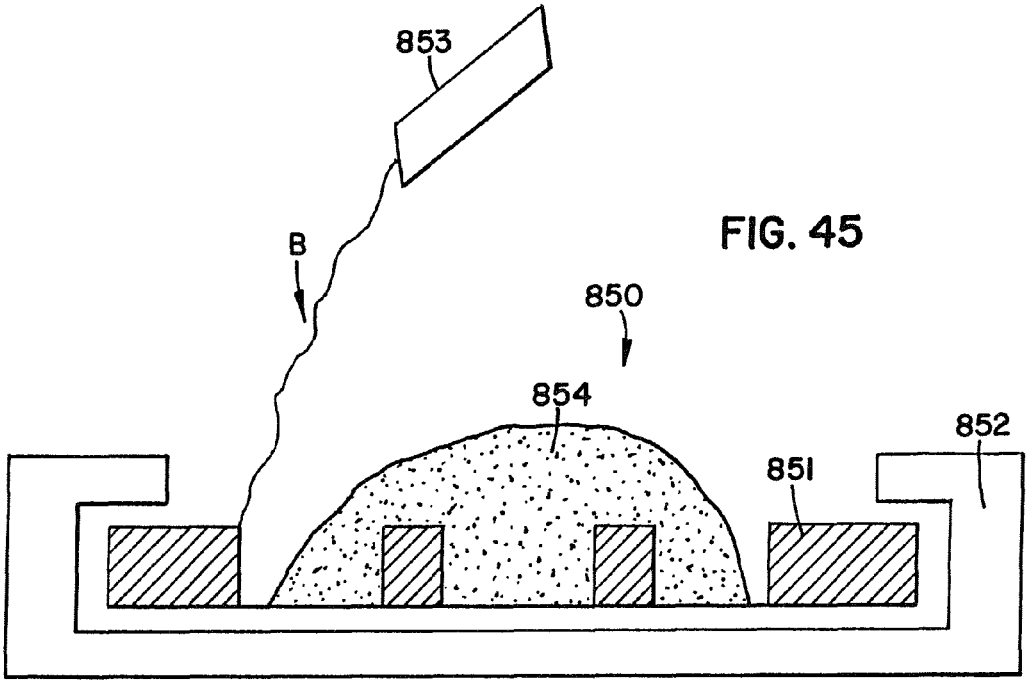
FIG. 45 is a cross-section of another embodiment product dispenser and carrier constructed according to the principles of the present invention including an out of product indicator in a second position.

A preferred embodiment out of product indicator 853 for use with product dispenser and carrier 850 is shown in FIGS. 44-45. The product dispenser and carrier 850 includes a product carrier 851 carrying a product 854 and a plate member 852. The out of product indicator 853 is preferably a tag on an elongate connecting member, which is preferably a string. One end of the string is connected to the tag and the other end of the string is operatively connected to the product carrier 851 proximate the side of the product carrier 851. The tag is positioned proximate the top of the product carrier 851 where the product 854 enters the apertures 856. This is shown in FIG. 44. As the product 854 becomes depleted the tag loosens and is eventually released from the product 854. When the tag is released, as in FIG. 45, the product 854 should be replaced.

A preferred embodiment out of product indicator 863 for use with product dispenser and carrier 860 is shown in FIGS. 46-47. The product dispenser and carrier 860 includes a product carrier 861 carrying a product 862. The product carrier 861 includes the out of product indicator 863, which is preferably fluorescing lines along the sides of the product carrier 861. As the product 862 becomes depleted the fluorescing lines become visible thereby indicating that the product 862 should be replaced. Alternatively, the product carrier 861 could be a different color and when this color is exposed the product 862 should be replaced.

It is understood that any of these features may be interchanged among the different preferred embodiments to create variations thereof and such variations are within the scope of the present invention. It is also understood that the plate member and the product carrier may be made in numerous different shapes and sizes and are not limited to those shown in the preferred embodiments. Further, it is recognized that the dimensions described herein are for illustrative purposes only and any dimensions suitable for the intended purpose are acceptable. In addition, it is also understood that the product dispenser and carrier may be used on the inner surface of a dryer or it may even be used in different applications such as pest elimination and dish washing to dispense products such as insect bait and drying agents, respectively. Also, the types of products that could be used with this device are softeners, sanitizers, water repellants, deodorizers, bleaches, soil repellants, dye-transfer inhibitors, fiber protecting polymers, fiber smoothers, UV light absorbers, anti-wrinkle agents, etc. Any of these products, as well as additional products, could be used with the present invention.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A dispenser for dispensing a fabric conditioner in a dryer, the dispenser being releasably attachable to an inner surface of the dryer, comprising:

a product carrier having a first side, a second side, and a plurality of voids; and a solid fabric conditioner product solidified onto the product carrier, a minor portion of the solid fabric conditioner product filling the plurality of voids and a substantial portion of the solid fabric conditioner product extending from the first side of the product carrier and being exposed, wherein the minor portion filling the plurality of voids allows the solid fabric conditioner product to be securely connected to the product carrier, and wherein the solid fabric conditioner product is configured and arranged for multiple use, wherein the plurality of voids is a plurality of apertures extending through the product carrier, the plurality of apertures being at least partially tapered on the second side of the product carrier.

2. The dispenser of claim 1, wherein the substantial portion is at least 85% of the solid fabric conditioner product and the minor portion is a remaining portion of the solid fabric conditioner product when initially operatively connected to the product carrier.

3. The dispenser of claim 1, further comprising a connecting member operatively connected to the second side of the product carrier for connecting the product carrier to the inner surface of the dryer, the connecting member being selected from the group consisting of a plate member, an adhesive, a releasable adhesive, a magnet, hook and loop, a hole plug, tape, and double sided tape.

4. The dispenser of claim 1, wherein the solid fabric conditioner product is solidified onto the product carrier using a method selected from the group consisting of casting, extrusion, and injection molding.

5. The dispenser of claim 4, wherein the minor portion fills the plurality of voids and the solid fabric conditioner product solidifies onto the product carrier thereby securing the solid fabric conditioner product onto the product carrier.

6. The dispenser of claim 1, further comprising an out of product indicator providing indication when the solid fabric conditioner product is low and the product carrier should be replaced.

7. The dispenser of claim 6, wherein the out of product indicator is an indicator selected from the group consisting of a switch, a light emitting diode, a beeper, a portion of hook material, a piece of recognizable material, a piece of foil, a tag connected to an elongate member, a fluorescent line, and a different color on the product carrier.

8. The dispenser of claim 1, further comprising an adjustable cover configured and arranged to releasably engage the product carrier and cover at least a portion of the solid fabric conditioner product, the adjustable cover being adjustable and removable to expose varying amounts of the solid fabric conditioner product.

9. The dispenser of claim 1, further comprising:

a) a plate member having a front side, a back side, and an attachment member;

b) a mating member of the product carrier, the mating member being configured and arranged to engage the attachment member thereby releasably connecting the plate member and the product carrier, whereby the product carrier is replaceable, wherein the substantial portion of the solid fabric conditioner product extends from the first side of the product carrier away from the plate member and the second side of the product carrier faces the plate member; and c) a connecting member operatively connected to the back side of the plate member, the connecting member operatively connecting the plate member to the inner surface of the dryer.

10. The dispenser of claim 9, wherein the connecting member is selected from the group consisting of an adhesive, a releasable adhesive, a magnet, hook and loop, a hole plug, tape, and double sided tape.

11. The dispenser of claim 1, wherein the product carrier supports the solid fabric conditioner product at an angle relative to the inner surface of the dryer.

12. The dispenser of claim 1, further comprising a plate member having a front side and a back side, the front side being operatively connected to the second side of the product carrier, a connecting member being operatively connected to the back side of the plate member, the connecting member operatively connecting the plate member to the inner surface of the dryer.

13. The dispenser of claim 12, wherein the product carrier and the plate member are integral.

14. The dispenser of claim 1, wherein the first side of the product carrier is dome-like shaped.

15. The dispenser of claim 1, wherein the solid fabric conditioner product has rounded top edges thereby having a dome-like shape.

16. The dispenser of claim 1, wherein the product carrier is configured and arranged for mounting to the inner surface of the dryer, the inner surface selected from the group consisting of a dryer door, a dryer fin, a leading edge of a dryer fin, a following edge of a dryer fin, and a center portion of a dryer fin.

17. The dispenser of claim 16, wherein multiple product carriers are mounted to the inner surface of the dryer.

18. The dispenser of claim 1, further comprising:

a) a mating member operatively connected to the product carrier; and b) a plate member operatively connected to the inner surface of the dryer, the plate member having a front side, a back side, and an attachment member, the attachment member being configured and arranged to mate with the mating member thereby releasably connecting the product carrier to the plate member.

19. The dispenser of claim 18, wherein the plate member is incorporated into the inner surface of the dryer.

20. A dispenser for dispensing a fabric conditioner in a dryer, the dispenser being releasably attachable to an inner surface of the dryer, comprising:

a product carrier having a first side, a second side, and a plurality of voids; and a solid fabric conditioner product solidified onto the product carrier, a minor portion of the solid fabric conditioner product filling the plurality of voids and a substantial portion of the solid fabric conditioner product extending from the first side of the product carrier and being exposed, wherein the minor portion filling the plurality of voids allows the solid fabric conditioner product to be securely connected to the product carrier, and wherein the solid fabric conditioner product is configured and arranged for multiple use, wherein the plurality of voids is selected from the group consisting of a plurality of apertures and a plurality of dove tail grooves.

21. A dispenser for dispensing a fabric conditioner in dryer, the dispenser being releasably attachable to an inner surface of the dryer, comprising:

a product carrier having a first side, a second side, and a plurality of voids; and a solid fabric conditioner product solidified onto the product carrier, a minor portion of the solid fabric conditioner product filling the plurality of voids and a substantial portion of the solid fabric conditioner product extending from the first side of the product carrier and being exposed, wherein the minor portion filling the plurality of voids allows the solid fabric conditioner product to be securely connected to the product carrier, and wherein the solid fabric conditioner product is configured and arranged for multiple use, wherein the plurality of voids is formed by members selected from the group consisting of grips, hooks, and loops.

22. A dispensing system for dispensing a solid fabric conditioner, comprising:

a) a dryer having an inner surface including a receiving member;

b) a product carrier configured and arranged to releasably engage the receiving member thereby releasably connecting the product carrier to the inner surface of the dryer, the product carrier including a void, wherein the void is a plurality of apertures extending through the product carrier, the plurality of apertures being at least partially tapered on the second side of the product carrier; and c) a solid fabric conditioner solidified onto the product carrier, a minor portion of the solid fabric conditioner filling the void to secure the solid fabric conditioner to the product carrier, a substantial portion of the solid fabric conditioner extending from the product carrier and being exposed, and wherein the solid fabric conditioner product is configured and arranged for multiple use.

23. The dispensing system of claim 22, wherein said inner surface is a surface selected from the group consisting of a dryer door, a dryer fin, a leading edge of a dryer fin, a following edge of a dryer fin, and a center portion of a dryer fin.

24. The dispensing system of claim 22, wherein the receiving member includes an attachment member and the product carrier includes a mating member, the attachment member being configured and arranged to releasably engage the mating member thereby releasably connecting the product carrier to the inner surface.

* * * * *